US010358866B2

(12) United States Patent
Quek

(10) Patent No.: US 10,358,866 B2
(45) Date of Patent: Jul. 23, 2019

(54) FLOODGATE

(71) Applicant: Parafoil Design & Engineering Pte Ltd, Singapore (SG)

(72) Inventor: Jwee Thiam Quek, Singapore (SG)

(73) Assignee: Parafoil Design & Engineering Pte Ltd, Singapore (SG)

( * ) Notice: Subject to any disclaimer, the term of this patent is extended or adjusted under 35 U.S.C. 154(b) by 0 days.

(21) Appl. No.: 15/578,507

(22) PCT Filed: Jun. 18, 2015

(86) PCT No.: PCT/SG2015/050167
§ 371 (c)(1),
(2) Date: Nov. 30, 2017

(87) PCT Pub. No.: WO2016/204691
PCT Pub. Date: Dec. 22, 2016

(65) Prior Publication Data

US 2018/0155979 A1 Jun. 7, 2018

(51) Int. Cl.
*E05D 7/06* (2006.01)
*E06B 9/04* (2006.01)
(Continued)

(52) U.S. Cl.
CPC ..... *E06B 9/04* (2013.01); *E05B 65/001* (2013.01); *E05B 65/0007* (2013.01); *E05C 7/02* (2013.01);
(Continued)

(58) Field of Classification Search
CPC ..... E05C 7/02; E06B 3/70; E06B 3/50; E06B 7/22; E06B 2003/7046; E06B 2009/007; E05B 65/001; E05D 15/48; E05Y 2900/40
(Continued)

(56) References Cited

U.S. PATENT DOCUMENTS 1,842,734 A * 1/1932 Saives ..... E05F 7/04 16/86 A
4,703,586 A * 11/1987 Smith ..... E06B 7/20 49/303
(Continued)

FOREIGN PATENT DOCUMENTS

GB 16284 A * 2/1910
GB 1378757 A * 12/1974
(Continued)

OTHER PUBLICATIONS

International Search Report (Form PCT/ISA/210) for PCT/SG2015/050167, issued from the Japan Patent Office, dated Aug. 4, 2015, 2 pages.
(Continued)

*Primary Examiner* — Jerry E Redman
(74) *Attorney, Agent, or Firm* — Kilyk & Bowersox, P.L.L.C.

(57) ABSTRACT

A floodgate is disclosed. The floodgate comprises: a panel for installation at a doorway to form a barrier against flooding; a hinge, the panel being movable between an opened position and a closed position about an axis of the hinge, the axis extending in use in an upright direction; and a sealing element coupled to an edge of the panel to provide sealing engagement with the ground when the panel is in the closed position thereby forming the barrier against flooding; wherein the hinge is configured to corporate with the panel to, upon the panel being moved from the closed position towards the opened position, cause the panel to move away from the ground thereby releasing the sealing engagement between the sealing element and the ground.

18 Claims, 44 Drawing Sheets

(51) Int. Cl.

| | |
|---|---|
| ***E06B 7/22*** | (2006.01) |
| ***E05B 65/00*** | (2006.01) |
| ***E05C 7/02*** | (2006.01) |
| ***E05D 15/48*** | (2006.01) |
| ***E06B 3/50*** | (2006.01) |
| ***E06B 3/70*** | (2006.01) |
| ***E06B 9/00*** | (2006.01) |
| *E05B 65/10* | (2006.01) |

(52) U.S. Cl.
CPC ..... *E05D 15/48* (2013.01); *E06B 3/50* (2013.01); *E06B 3/70* (2013.01); *E06B 7/22* (2013.01); *E06B 9/00* (2013.01); *E05B 65/1006* (2013.01); *E05Y 2900/40* (2013.01); *E06B 2003/7046* (2013.01); *E06B 2009/007* (2013.01)

(58) Field of Classification Search
USPC ..... 49/236, 237, 238, 239, 240, 241, 242, 49/243, 244, 245, 303, 306, 307, 308, 49/309, 310, 311, 312, 313, 314
See application file for complete search history.

(56) References Cited

U.S. PATENT DOCUMENTS

| | | | | |
|---|---|---|---|---|
| 10,094,162 | B2 * | 10/2018 | Snape | E06B 7/23 |
| 2006/0283087 | A1 * | 12/2006 | Baxter | E06B 7/20 49/306 |
| 2014/0366455 | A1 * | 12/2014 | Helton | E06B 7/16 49/483.1 |
| 2017/0167097 | A1 * | 6/2017 | Obermeyer | E02B 7/44 |
| 2018/0155979 | A1 * | 6/2018 | Quek | E06B 7/22 |

FOREIGN PATENT DOCUMENTS

| | | | | |
|---|---|---|---|---|
| GB | 2176835 | A | * | 1/1987 |
| GB | 2353554 | A | | 2/2001 |
| GB | 2473907 | | * | 7/2011 |
| GB | 2521932 | A | * | 8/2015 |
| JP | 2002357043 | A | | 12/2002 |
| JP | 2004092361 | A | | 3/2004 |
| JP | 2005113606 | A | | 4/2005 |
| JP | 2012031658 | A | | 2/2012 |
| JP | 2014080816 | A | | 5/2014 |
| JP | 2015090017 | A | | 5/2015 |

OTHER PUBLICATIONS

Written Opinion of the International Searching Authority (Form PCT/ISA/237) for PCT/SG2015/050167, issued from the Japan Patent Office, dated Aug. 4, 2015, 4 pages.

Supplementary Partial European Search Report for European Application No. EP 15895764.7, published by the European Patent Office (EPO), dated Jan. 17, 2019, including corresponding Communication,Information on Search Strategy, 1-page Annex, and 5-page EPO Form 1707.

* cited by examiner

DETAIL A

DETAIL E

DETAIL G

DETAIL F

DETAIL I

DETAIL H

DETAIL K

DETAIL J

DETAIL L

FLOODGATE

BACKGROUND OF THE INVENTION

This invention relates to a floodgate, and in particular, to a floodgate which provides access to an emergency exit, for example, during a building fire.

Flooding (e.g. due to increased rainfall) may cause widespread damage to property, infrastructure and the economy. Floodgates (or flood barriers) are an effective measure for preventing floods from entering an infrastructure (for example, a building or an underground car park) in addition to existing drainage systems. For example, during a flood, a floodgate in the form of a panel is erected to form an obstruction to protect the infrastructure from the ingress of the flood water. However, erected floodgates may impose safety risks during their use, especially in a case of an emergence such as a building fire etc. In such circumstances, the erected floodgate panel may obstruct exits of the building and hinder the evacuation process during an emergency.

Therefore, it is desirable to provide an improved floodgate to address the above concern.

SUMMARY OF INVENTION

In general terms, the invention proposes a floodgate having a panel which is pivotable about a hinge having a generally vertical axis, in which the hinge corporates with panel to move the panel away from the ground when the panel swings towards an opened position so that a sealing element coupled to a bottom edge of the panel is lifted off to allow the panel to move to the opened position. This allows the sealing element to form a watertight seal with the ground to obstruct flood water when the panel is in a closed position, and to allow the panel be easily moved towards the opened position without wearing and tearing the sealing elements against the ground. Such a floodgate may be provided at an emergency exit of a building, since its panel can be easily swung to unblock the exit to allow people within the infrastructure to gain access to the exterior, especially in case of an emergency.

Specifically, in an aspect of the invention, there is provided a floodgate which has a panel for installation at a doorway to form a barrier against flooding. The floodgate further has a hinge and the panel is movable between an opened position and a closed position about an axis of the hinge. In use, the axis of the hinge extends in an upright direction. The floodgate further comprises a sealing element coupled to an edge of the panel to provide sealing engagement with the ground when the panel is in the closed position thereby forming the barrier against flooding. In use, the hinge corporates with the panel to, upon the panel being moved from the closed position towards the opened position, cause the panel to move away from the ground thereby releasing the sealing engagement between the sealing element and the ground.

The floodgate is advantageous because it allows the floodgate panel to be moved about a substantially vertical axis, instead of a horizontal axis. This means that no manual force will be required to directly counter the weight of the panel in order to lift the floodgate panel. In other words, the floodgate is allowed to be swung like a hinged door. In addition, the sealing element is protected from rubbing against the ground when the panel is moved towards the opened position so that the sealing element is able to maintain its watertight sealing property with the ground when the panel is in the closed position, even after repeated uses or swings. In addition, this allows the panel to be moved readily, within minimal friction against the ground, facilitating a fast evacuation during an emergency. Furthermore, the floodgate may be operated (both opening and closing) manually without requiring any power supply, which may be cut off during heavy rain or floods.

In one example, the hinge comprises a rising hinge, which is typically a movable mechanism for connecting two objects which permit not only the relative angular movement between the objects but also relative translational movement between the objects along a direction parallel to the hinge axis.

The sealing element comprises a sealing surface forming sealing engagement with the ground, the sealing surface comprising corrugations. For example, the corrugations comprise ribs extending in a direction at an angle to a direction perpendicular to the panel. This allows the flow of ingressing water to be obstructed by the ribs (which may function as a multi-layer barrier) of the sealing elements to form a more effective seal.

Upon the sealing engagement being formed, the sealing surface may be contiguous with a threshold plate coupled to the ground.

In some embodiments, a plurality of sealing elements are attached to a plurality of edges of the panel. This allows sealing engagement to be formed with neighboring structures at the respective edges to achieve a water tight barrier.

In one example, the sealing element has a cross-section tapered towards the ground. The cross-section is perpendicular to a length of the edge. This allows the sealing element to fit more closely into the spacing defined by the edge of the panel and any neighboring structures thereby providing a more effective seal.

The floodgate typically has a locking member for securing the panel in the closed position for withstanding the pressure of the ingressing water. An actuating member may be provided to deactivate the locking member to allow the panel to move towards the opened position.

The panel may be coupled to a wall via the hinge. In one example, the panel is connected to a support post via the hinge and the support post laterally projects from a plane defined by the wall. An edge of the panel adjacent to the hinge may form sealing engagement with the support post.

The panel is formed of aluminum based composite material. This provides adequate rigidity without a heavy weight normally required of structural members.

In another embodiment, a second panel movable between an opened position and a closed position about an axis of a second hinge may be provided. The axis also extends, in use, in an upright direction. The second panel works in a similar way as the first panel and the two panels may be disposed between the axes of the two hinges, and cooperate to form sealing engagement at opposing neighboring edges of the panels.

Alternatively, the invention may be expressed as a floodgate having a first panel for installation at a doorway to form a barrier against flooding; at least one hinge, the first panel being movable between an opened position and a closed position about an axis of the hinge, the axis extending in use in an upright direction; and a sealing element coupled to an edge of the first panel to provide sealing engagement with the ground when the first panel is in the closed position, thereby forming the barrier against flooding; wherein the hinge is arranged to cooperate with the first panel to, upon the panel being moved from the closed position towards the opened position, cause the first panel to move away from the ground thereby releasing the sealing engagement between the sealing element and the ground. The floodgate further comprises a coupling mechanism configured to cooperate with a second panel that is movable about a second axis parallel to the axis of the hinge. The coupling mechanism is configured to, upon the second panel pivoting about the second axis, cause the first panel to pivot about the axis of the hinge at a corresponding angle. This floodgate may be used for fitting onto a fire escape door (e.g. the second panel) for installation at an emergency exit of a building. The coupling mechanism advantageously allows for the relative movement between the fire escape door and the floodgate panel to be accommodated when they are made to pivot about their respective axes concurrently at a corresponding pace.

For example, the coupling mechanism may be configured to accommodate relative movement of the panels along either of or both an upright direction and a lateral direction orthogonal to the upright direction.

In one example, the coupling mechanism has a linking member configured to cooperate with a guide slot extending along the lateral direction of the panel and the linking member is operable to pivot about the guiding slot.

BRIEF DESCRIPTION OF DRAWINGS

It will be convenient to further describe the present invention with respect to the accompanying drawings that illustrate possible embodiments of the invention. Other embodiments of the invention are possible, and consequently the particularity of the accompanying drawings is not to be understood as superseding the generality of the preceding description of the invention.

FIG. 1(*b*) is a section view of the floodgate along an axis B-B of FIG. 1(*a*).

FIG. 1(*c*) is a section view of the floodgate along an axis A-A of FIG. 1(*a*).

FIG. 1(*d*) is an expanded view of Detail A in FIG. 1(*a*).

FIG. 1(*e*) is an expanded view of Detail C in FIG. 1(*c*).

FIG. 3(*b*) is a section view of the floodgate along an axis F-F of FIG. 3(*a*).

FIG. 3(*c*) is a section view of the floodgate along an axis E-E of FIG. 3(*a*).

FIG. 3(*d*) is an expanded view of Detail B in FIG. 3(*b*).

FIG. 3(*e*) is an expanded view of Detail E in FIG. 3(*c*).

FIG. 5(*b*) is a section view of the floodgate along an axis D-D of FIG. 5(*a*).

FIG. 5(*c*) is a section view of the floodgate along an axis C-C of FIG. 5(*a*).

FIG. 5(*d*) is an expanded view of Detail D in FIG. 5(*c*).

FIG. 8(*b*) is a section view of the floodgate along an axis H-H of FIG. 8(*a*).

FIG. 8(*c*) is a section view of the floodgate along an axis G-G of FIG. 8(*a*).

FIG. 8(*d*) is an expanded view of Detail E in FIG. 8(*c*).

FIG. 11(*c*) is a section view of the floodgate along an axis A-A of FIG. 11(*a*).

FIG. 11(*d*) and FIG. 11(*e*) are expanded views of Details F and G in FIGS. 11(*b*) and 11(*c*), respectively.

FIG. 12(*b*) is a section view of the floodgate along an axis A-A of FIG. 12(*a*).

FIG. 12(*c*) and FIG. 12(*d*) are expanded views of Details H and I in FIGS. 12(*a*) and 12(*b*), respectively.

FIG. 13(*c*) and FIG. 13(*d*) are expanded views of Details J and K in FIGS. 13(*a*) and 13(*b*), respectively.

FIG. 14(*b*) is an expanded view of Detail G in FIG. 14(*a*).

DESCRIPTION OF EMBODIMENTS

Figure 1B:
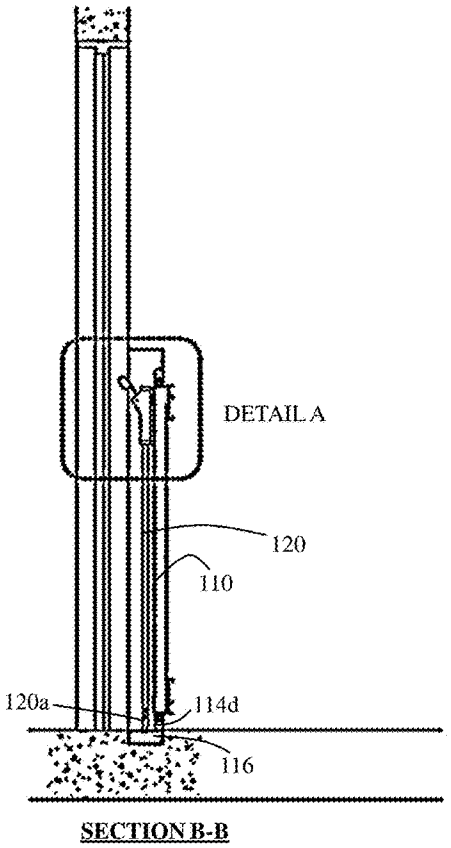
FIG. 1(*a*) is an elevation view of a floodgate according to an embodiment.
Figure 1A:
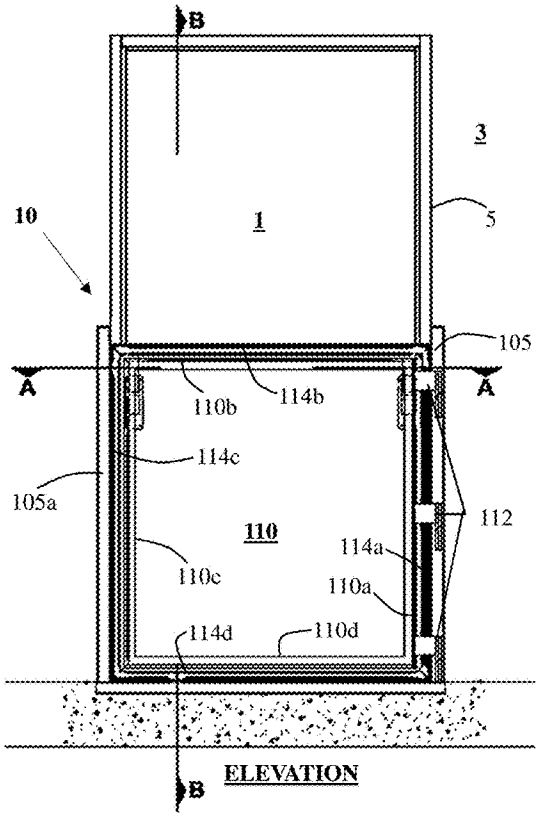
Figure 1C:
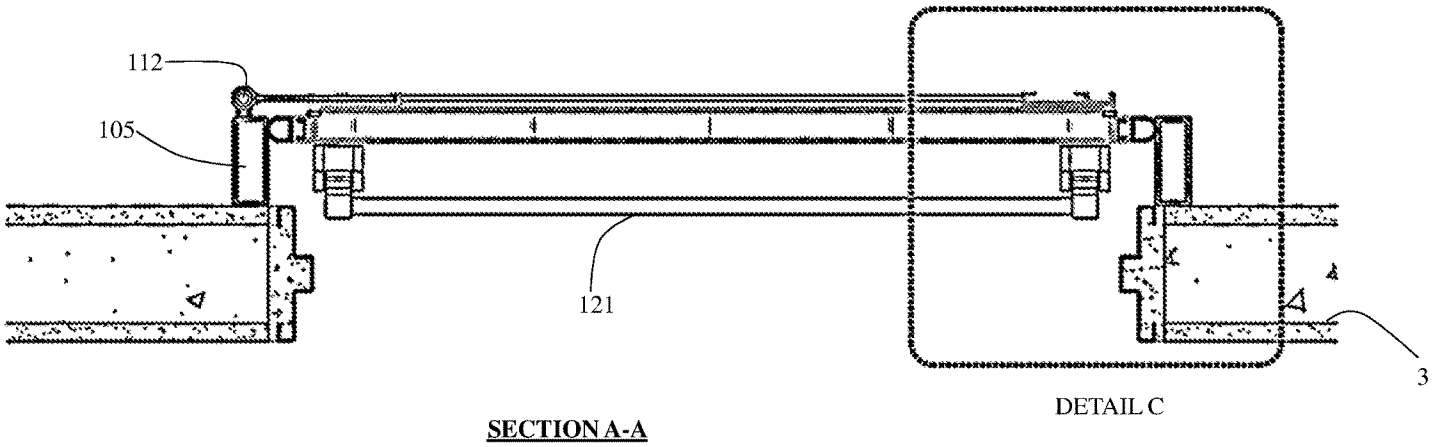
Figure 1D:
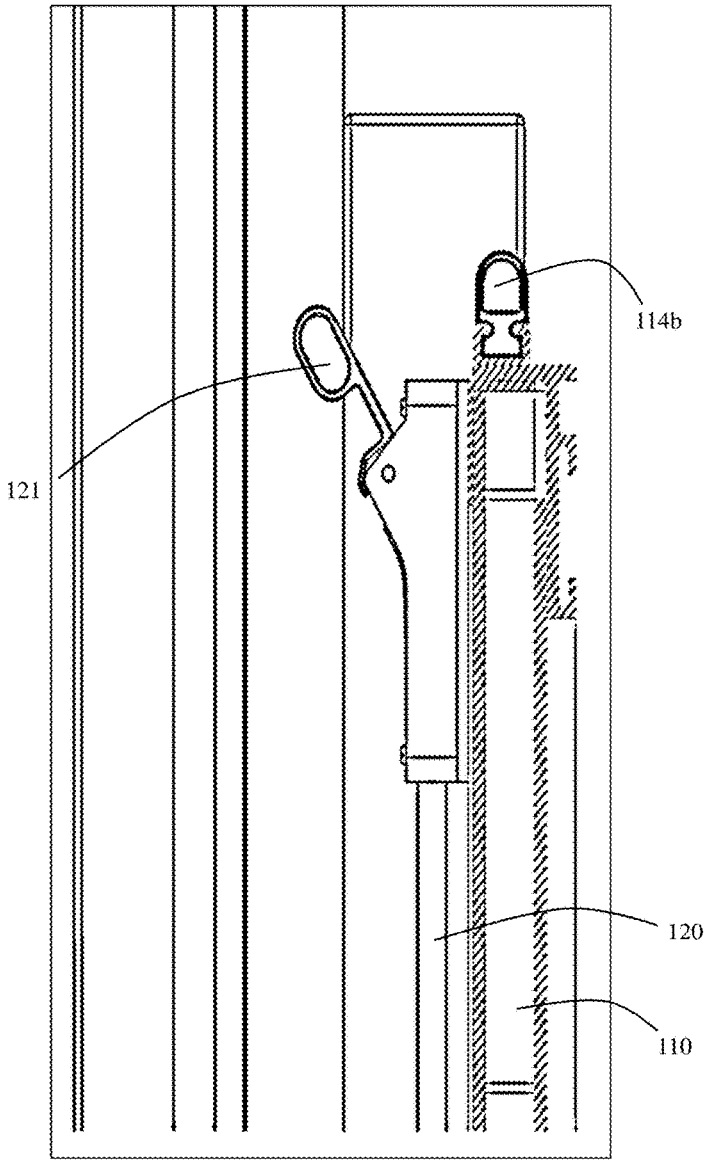
Figure 1E:
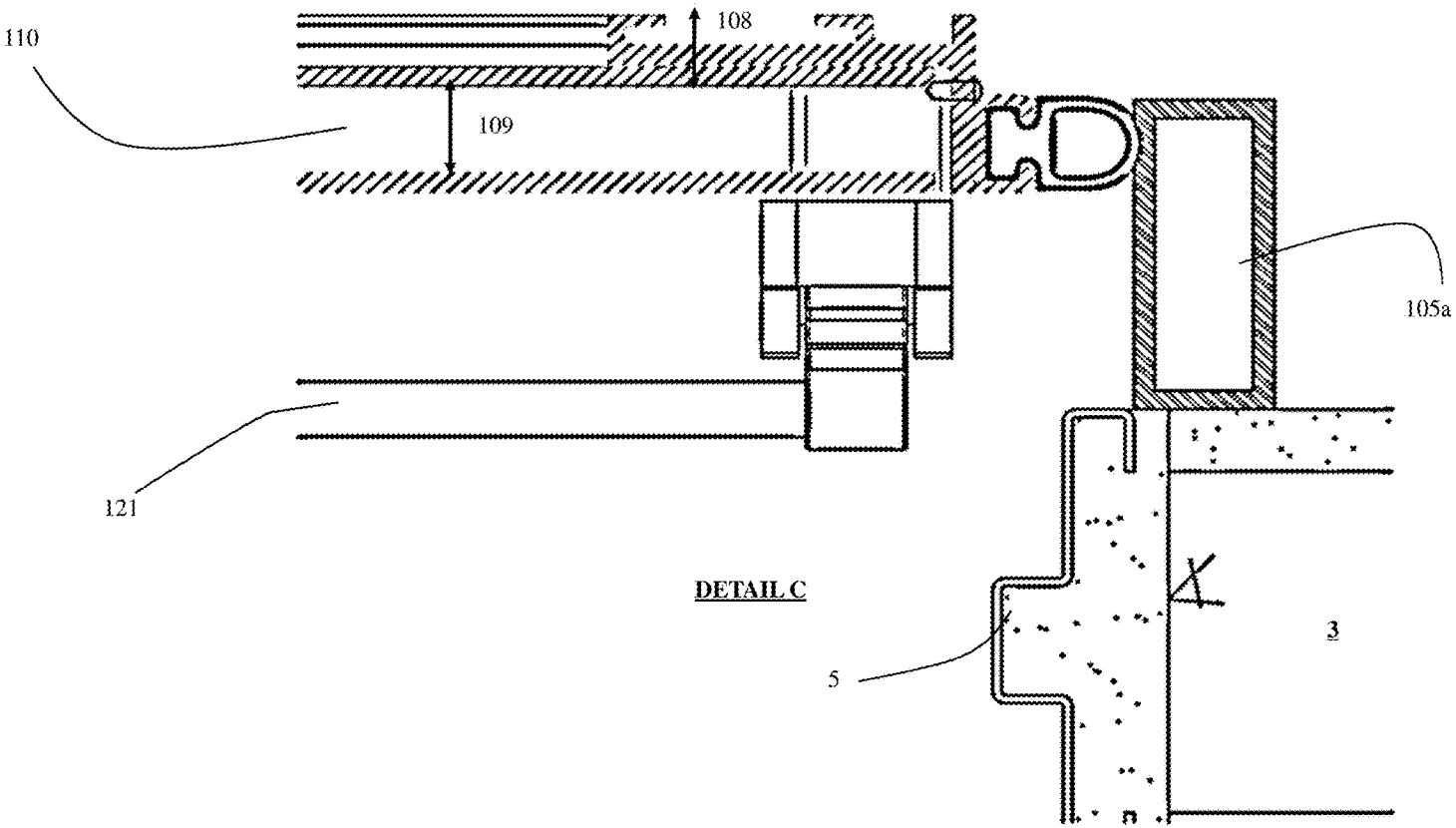

FIGS. 1(*a*), 1(*b*), 1(*c*), 1(*d*), and 1(*e*) show a floodgate 10 installed at a doorway 1 of an entrance or exit for protection against intruding flood water. In this embodiment, the doorway 1 of the exit (such as an emergency fire exit) is defined by a wall frame 5 of a wall 3. The floodgate 10 has a panel 110 having one edge 110*a* pivotably coupled to an upright support post such as a vertical stanchion 105 via hinges 112. In this example, the hinges 112 are rising hinges. The vertical stanchion 105 is arranged to proximate the wall frame 5 and is laterally projected from the wall 3 towards the building exterior as shown in FIGS. 1(*c*) and 1(*e*). Another vertical stanchion 105*a* is symmetrically provided at the opposing side of the doorway 1 to interface the panel 110 as will be described later. The panel 110 is pivotable about the hinges 112 between an opened position and a closed position at the edge 110*a* about the hinges 112, as shown in FIGS.

2(*a*) and 2(*b*). In the closed position, the panel 110 comes into sealing engagement with the neighboring structures thereby forming a barrier against ingress of flood water. In the opened position, the panel 110 pivots away from the closed position to provide an access passage along the doorway 1.

Preferably, the panel 110 is made of composite material that provides rigidity without a heavy weight normally required of structural members. For example, the panel 110 is made of an egg-crate panel cladded with aluminum sheets. The thickness of the egg-crate panel 108 and the aluminum cladding 109 are 4 mm and 6 mm, respectively (see FIGS. 1(*c*)-1(*e*)). It will be understood that the thickness of the cladding 109 is dependent on the height and/or pressure of the floodgate water for which the floodgate panel 110 is designed to withstand. In this example, the thickness of the cladding 109 is preferably at least 3 mm.

In this example, the vertical stanchions 105, 105*a* are made of stainless steel of at least 3 mm thickness to provide structural integrity for the panel 110. Stainless steel also provides a good anti-corrosion property and a smooth surface for reducing friction against sealing elements (as will be described later), which is therefore suitable for this application. The vertical stanchions 105, 105*a* may be permanently fixed against the building structure and a layer of mastic sealant may be lined to provide a watertight seal with the building structure.

A plurality of sealing elements 114*a*, 114*c*, 114*d* are coupled to the respective edges 110*a*, 110*c*, 110*d* of the panel 110 for forming a watertight sealing engagement with the respective neighboring structures when the panel 110 is at the closed position. For example, the sealing element 114*d* is configured to form a watertight seal with a threshold plate 116 of the doorway 1. The threshold plate 116 flushes with the ground and is made of metallic material such as stainless steel which minimizes any friction against the sealing element 114*d* when the panel 110 is moved into or out of the closed position. Other types of material are also possible. In this example, the sealing elements 114*a*, 114*c* arranged at opposing edges 110*a*, 110*c* respectively cooperate with the vertical stanchions 105, 105*a* to provide a watertight barrier against the flood. In use, the sealing elements deform to bias against the neighboring structures thereby snuggly fitting into the spacing between the edges of the panel and the corresponding neighboring structures to form watertight seals. The sealing elements 114*a*, 114*c*, 114*d* used in this example are vulcanized thermoplastic vulcanizers-type (TPV) Ethylene Propylene Diene Monomer (EPDM) seals. Advantageously, this material has good resistance against UV and Ozone as well as a heat resistance of −40 to 130 degrees Celsius. As shown in FIGS. 1(*a*) and 1(*c*), the sealing elements 114*a*, 114*c*, 114*d* are elongate and extend along the respective edges 110*a*, 110*c*, 110*d*. The sealing elements 114*a*, 114*c*, 114*d* have a cross-section which tapers towards the free end (which is to be in contact with neighboring structures). For example, a D-shaped cross-section allows the sealing elements 114*a*, 114*c*, 114*d*, upon a compression, to fit more closely into the spacing at the corner defined by an edge intersected by the vertical stanchion 105, 105*a* and the threshold plate 116. A further sealing element 114*b* may also be provided at the corresponding edge 110*b* opposite to the edge 110*d* of the panel 110.

Upon the end of the sealing elements 114*a*, 114*b*, 114*c*, 114*d* being compressed against the respective neighboring structures, a sealing surface of each sealing element forms sealing engagement with the respective neighboring structure. The sealing surface is provided with corrugations which function as multiple barriers against the ingress of flood water therefore further preventing water leakage, as compared to a flat sealing surface. The corrugations may be formed by ribs projecting from the general profile of the sealing surface and the ribs are extending along the surface in a direction at an angle with respect to (i.e. instead of being parallel to) a direction perpendicular to the plane of the panel 110 or the direction of ingressing flood water. Therefore, the flow of ingressing water would be obstructed by the ribs of the sealing elements. The corrugations may be designed to minimize any friction between the sealing element 114*d* and the threshold plate 116. The sealing elements are typically made of a material which is able to withstand a compression load required for forming the seal. In another example, the sealing elements have a water resistant and/or anti-corrosion coating.

Figure 2A:
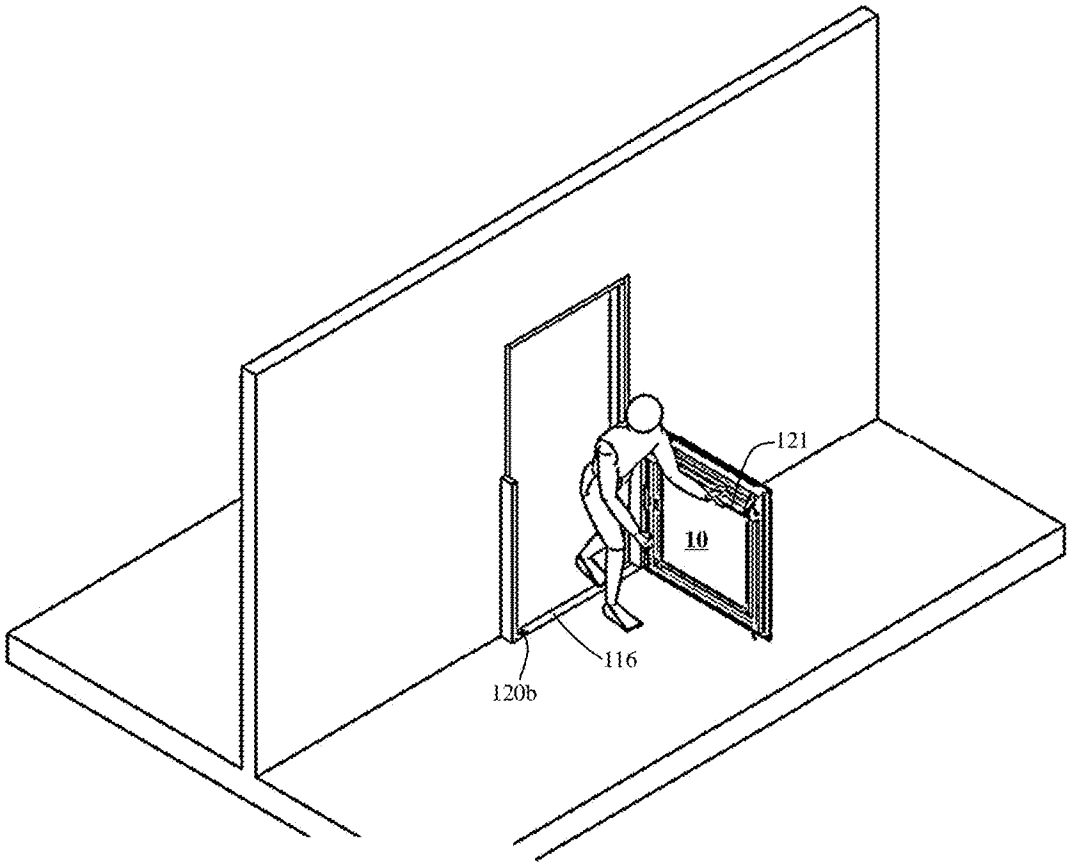
FIG. 2(*a*) and FIG. 2(*b*) are front axonometric views of the floodgate in an opened and a closed position, respectively.
Figure 2B:
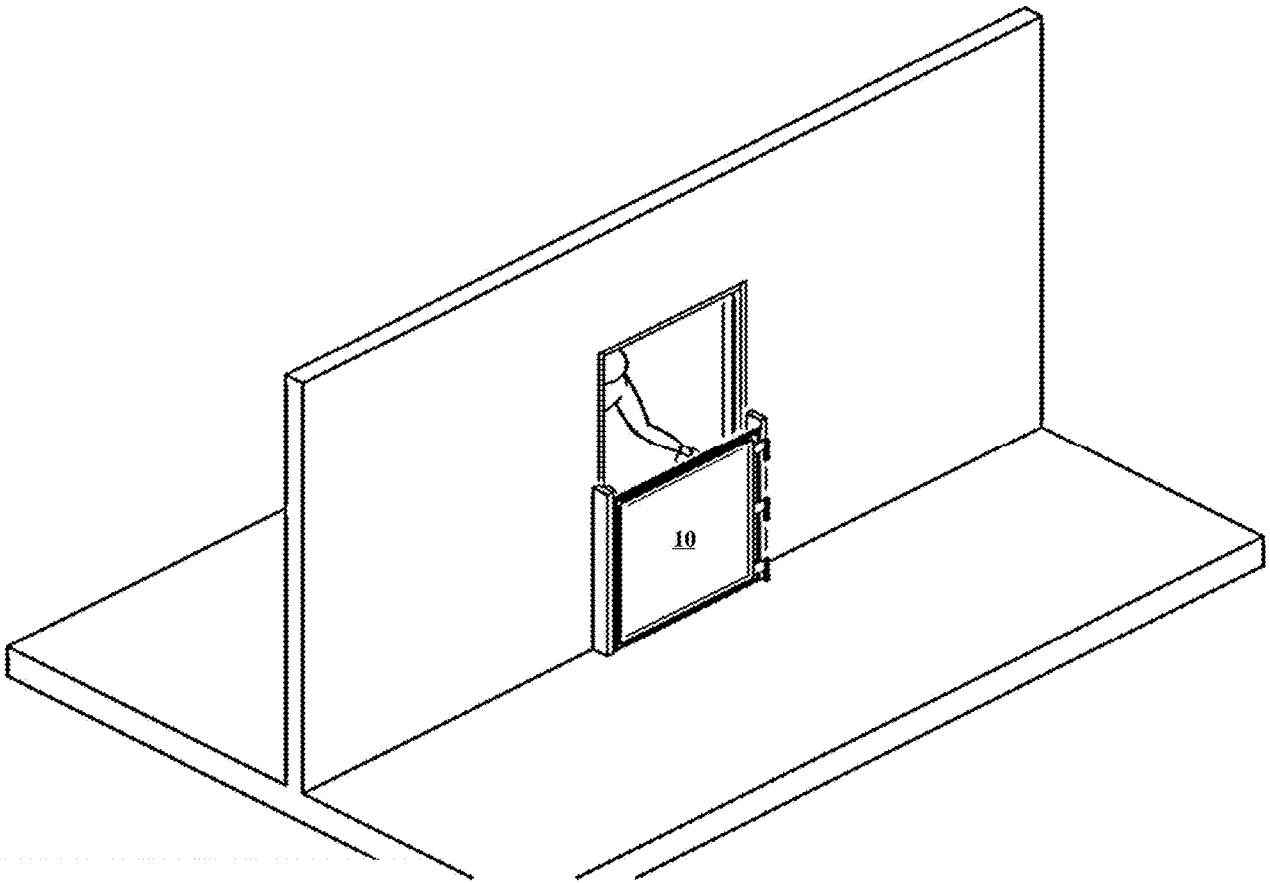
Figure 3B:
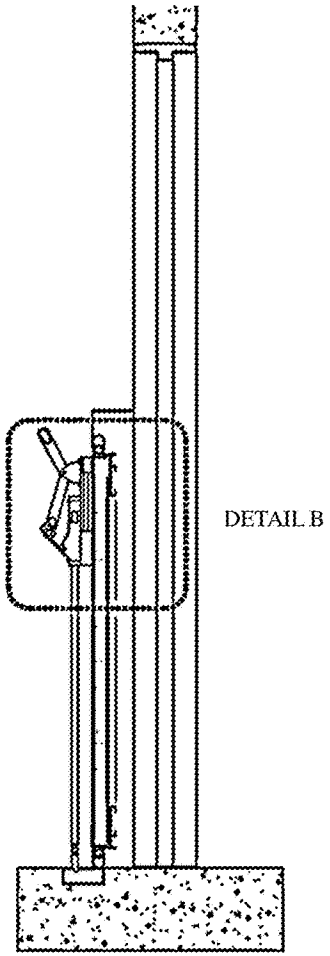
FIG. 3(*a*) is an elevation view of a floodgate according to a further embodiment.
Figure 3A:
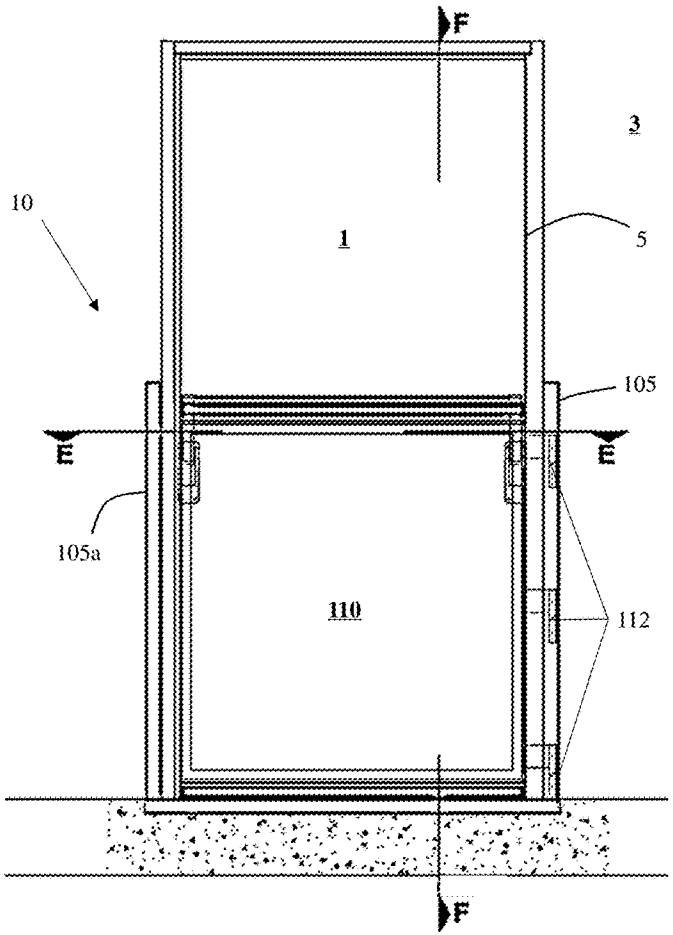
Figure 3C:
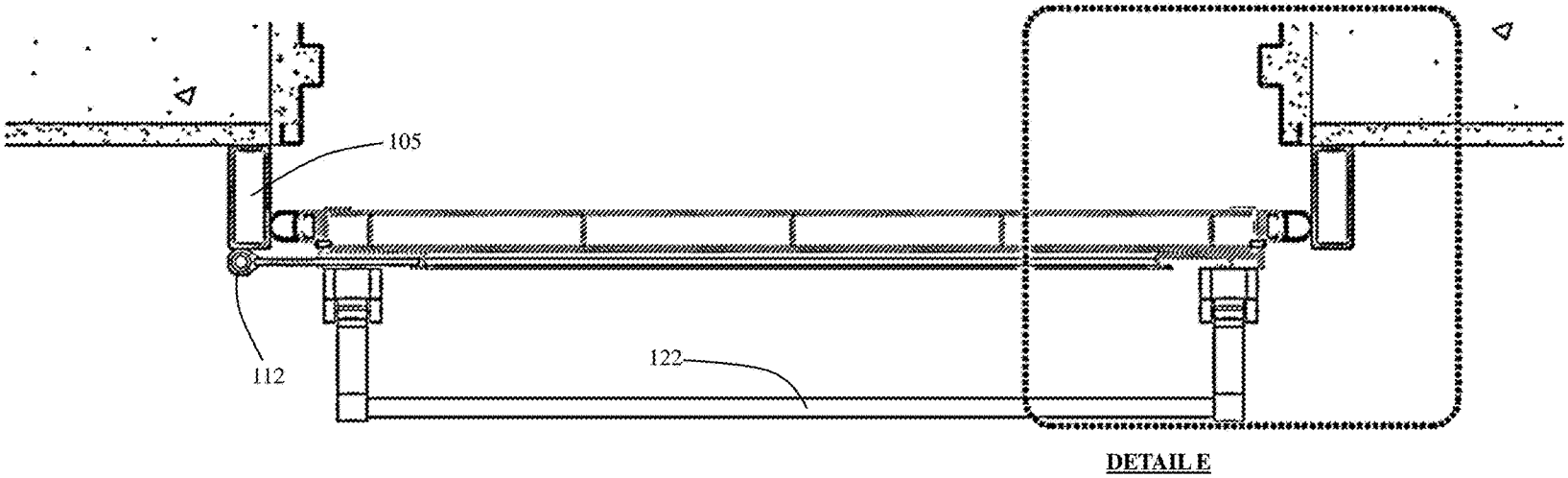
Figure 3D:
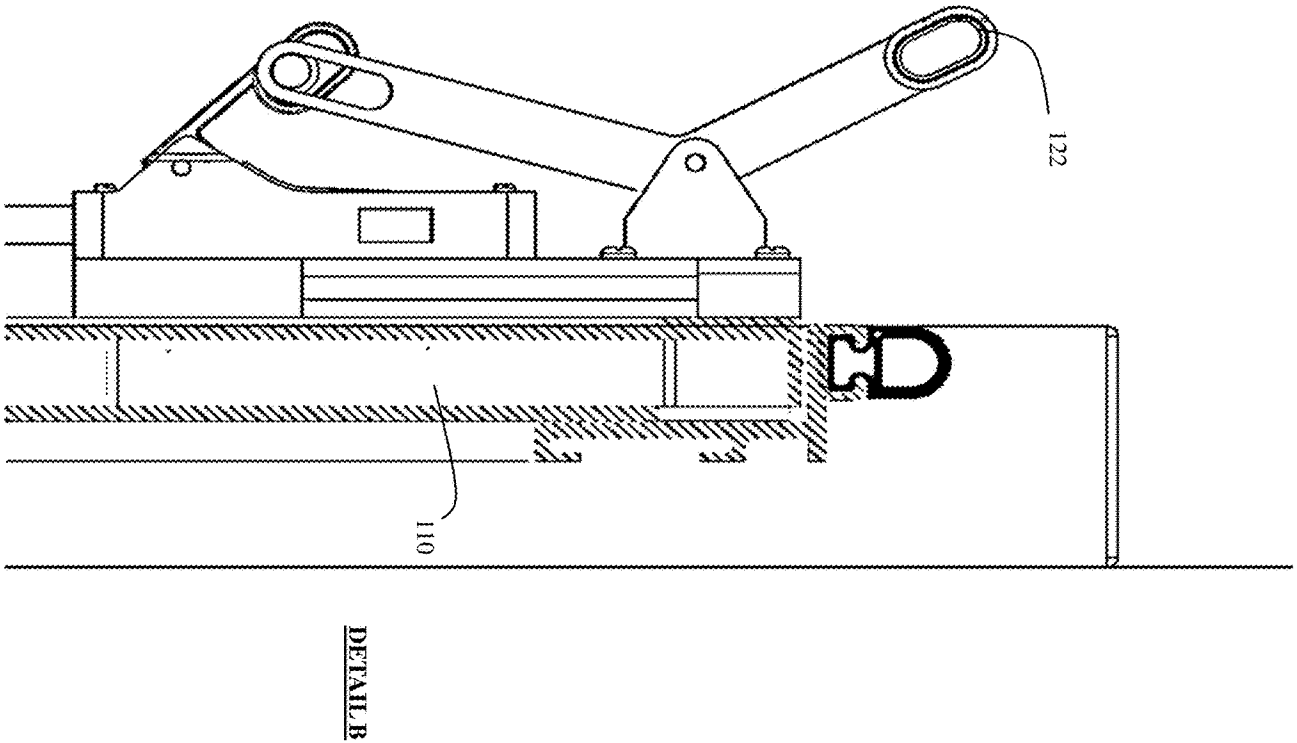
Figure 3E:
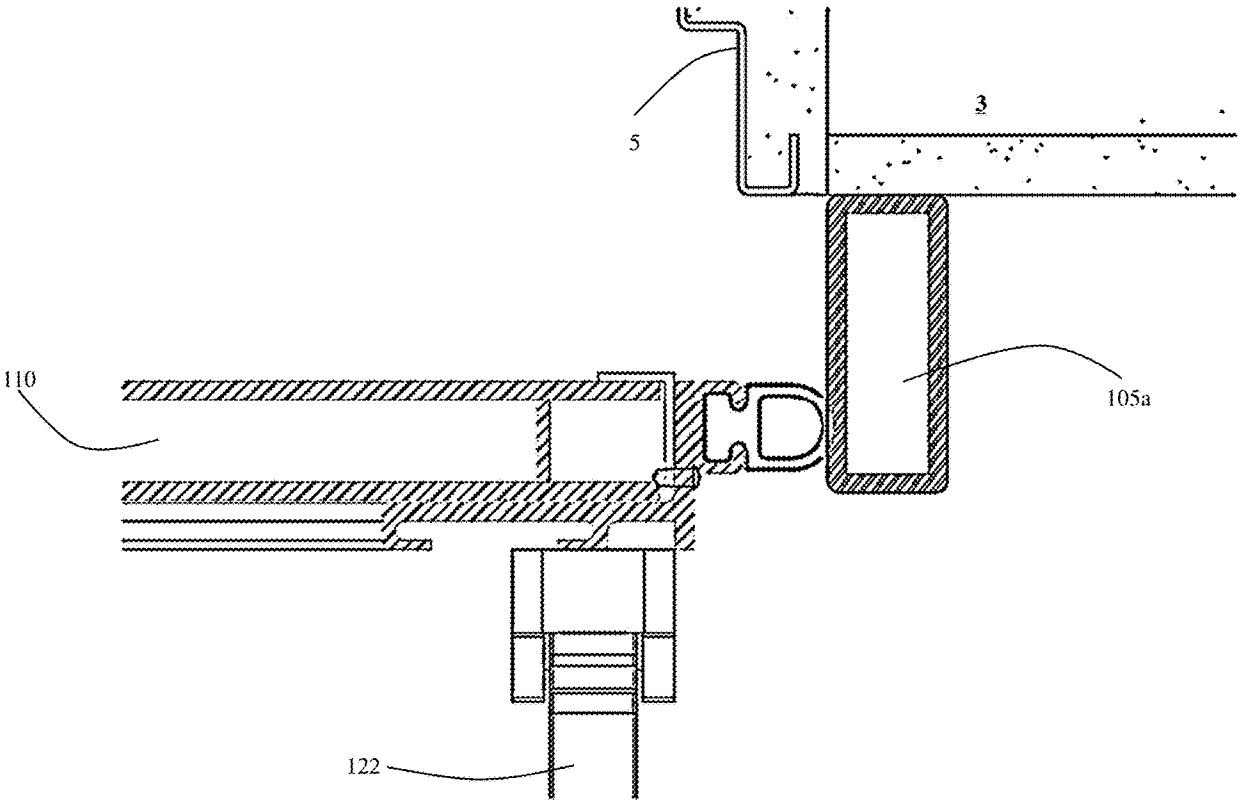

The hinges 112 are configured to cooperate with the panel 110 to move the panel 110 away from the ground upon the panel 110 being moved towards the opened position. In this example, the hinges 112 are rising hinges such that the panel 110 is lifted off the ground as the panel 110 pivots away from the closed position. This in turn releases the sealing engagement between the sealing element 114*d* and the threshold plate 116 or the ground as the sealing element 114*d* loses contact with the threshold plate 116 or the ground. The working mechanisms of the rising hinges are described in more detail later (for example, with respect to FIG. 13(*a*)). As shown in FIG. 1(*b*), a locking mechanism is coupled to the panel 110 for securing it in the closed position. In this example, a shoot bolt 120 having an end plug 120*a* is biased into the ground and retained by a retaining mechanism such as a keep plate 120*b*. The keep plate 120*b* flushes with the ground when the panel 110 is in the closed position. The keep plate 120*b* may be formed by the threshold plate 116 with an opening in communication with a depression on the ground. This prevents the panel 110 from swinging about the hinges 112. During a flood, the locking mechanism latches the panel 10 thereby holding the panel 10 in the closed position to withstand the ingress of water (see FIG. 2(*b*)). An actuating member is operable to retract the end plug 120*a* of the shoot bolt 120 from the ground therefore deactivating the locking member to allow the panel 110 to move pivot towards opened position as shown in FIG. 2(*a*). In one embodiment, a push-bar 121 mechanically coupled to the shoot bolt 120 is provided as the actuating mechanism. Upon being depressed towards the panel 110, the push-bar 121 pivots to lift the shoot bolt 120 and its end plug 120*a* off the ground thereby permitting the panel 110 to swing outwards to the opened position. This allows the building occupiers to readily access the emergency exit in case of a building fire, that is to say, to deactivate the floodgate 10 by pushing the panel 110 to the opened position to provide an unobstructed passageway to the exterior of the building.

Figure 4A:
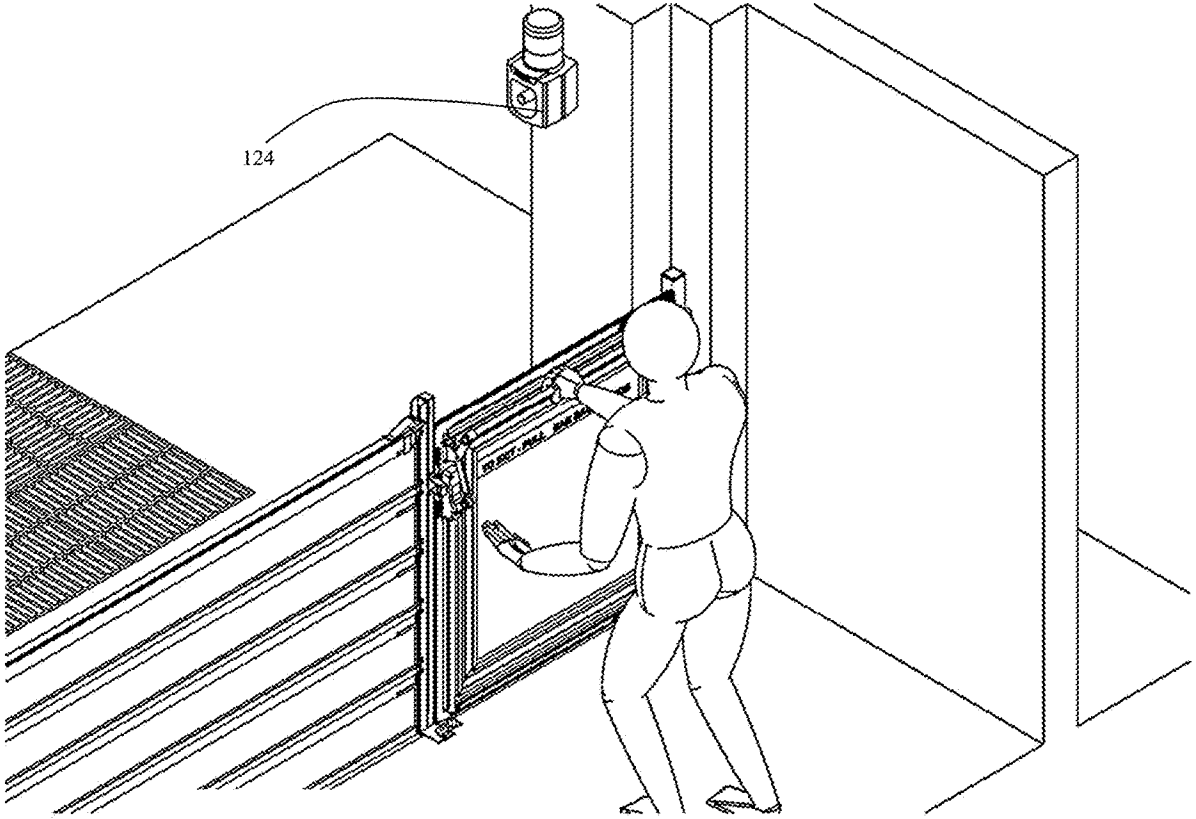
FIG. 4(*a*) and FIG. 4(*b*) are rear axonometric views of a floodgate in a closed and an opened position, respectively.
Figure 4B:
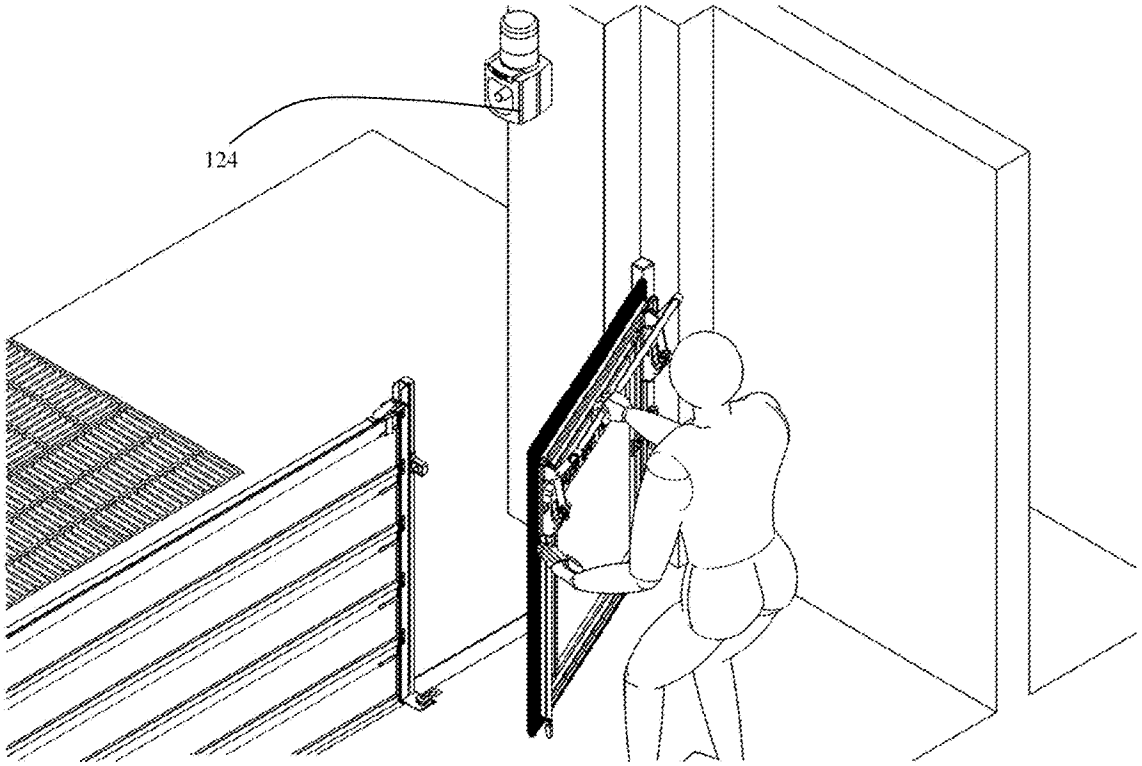
Figure 5A:
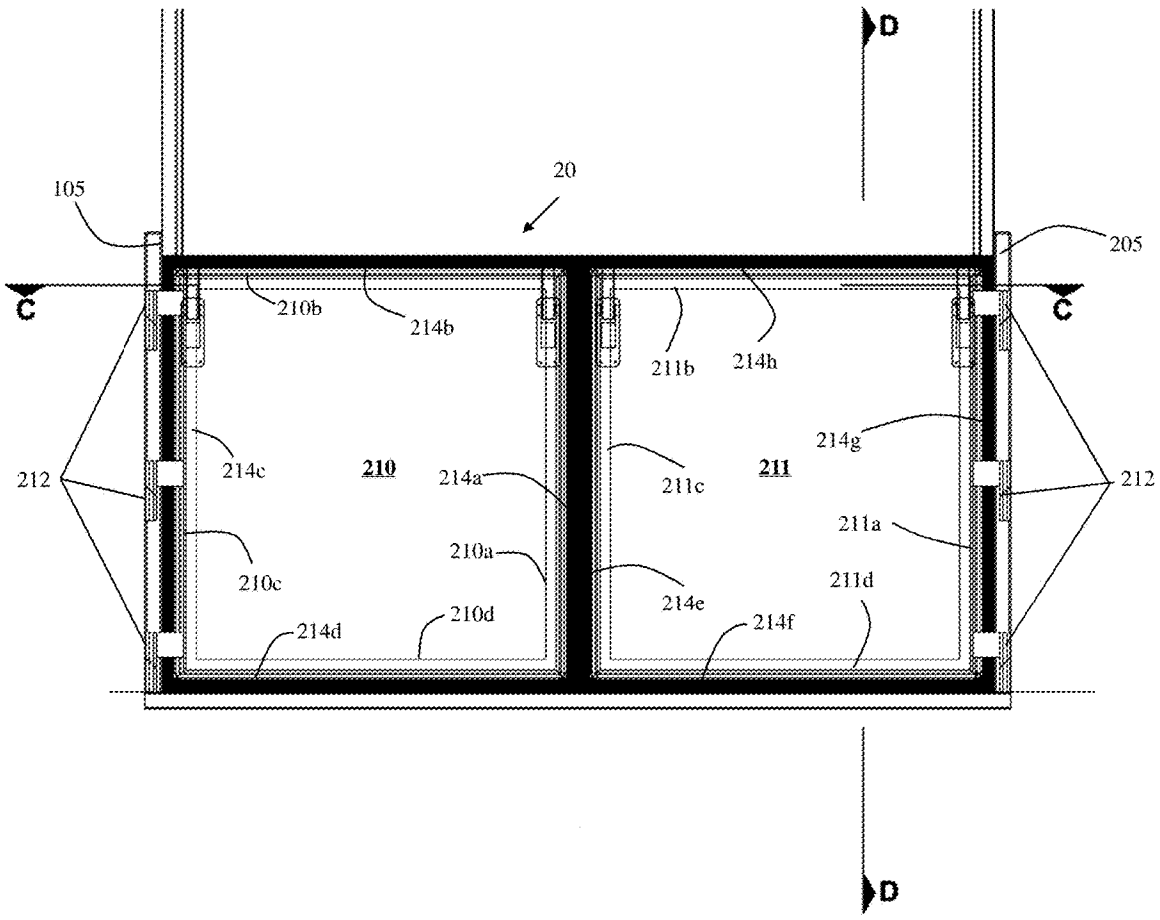
FIG. 5(*a*) is an elevation view of a floodgate according to another embodiment.
Figure 5B:
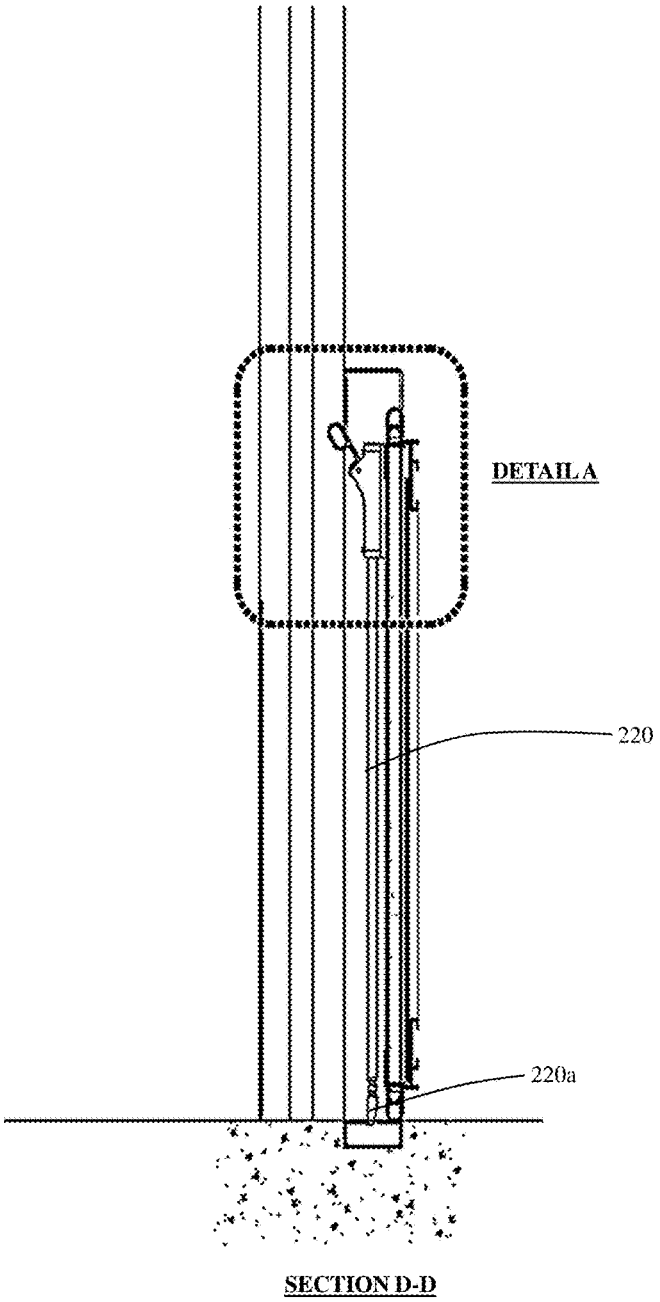
Figure 5C:
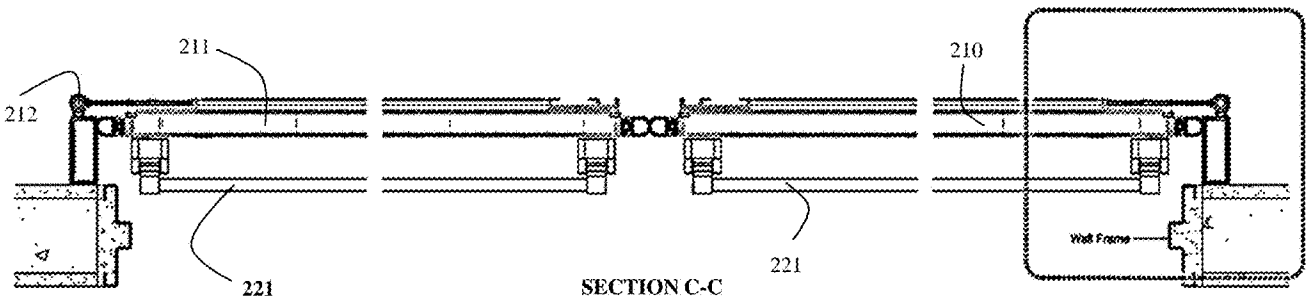
Figure 5D:
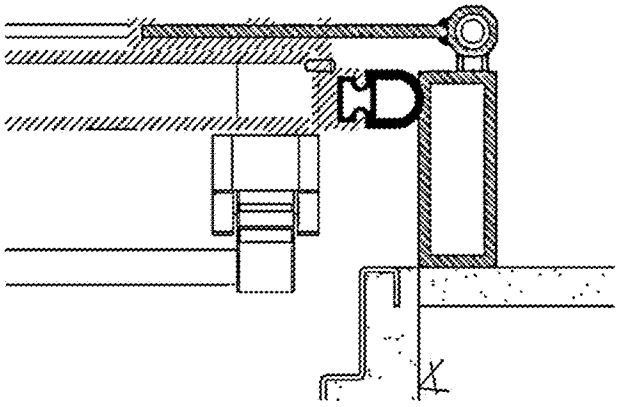

In another embodiment as shown in FIGS. 3(*a*) 3(*c*) FIGS. 3(*a*)-3(*e*), a floodgate 10 has a panel 110 having one edge 110*a* pivotably coupled to an upright support post such as a vertical stanchion 105 via hinges 112. The vertical stanchion 105 is arranged to proximate the wall frame 5 and is laterally projected from the wall 3 towards the building interior (see FIGS. 3(*c*) and 3(*e*)). Another vertical stanchion 105*a* is symmetrically provided at the opposing side of the doorway 1 to interface the panel 110. The panel 110 is pivotable about the hinges 112 between an opened position and a closed position at the edge 110*a* about the hinges 112, as shown in FIGS. 4(*b*) and 4(*a*) respectively. In other words, the panel 110 can be swung inwards (i.e. towards the building occupier or the interior of the building) to an opened position to provide an access passage along the doorway 1. Similar to the embodiment described earlier, in the closed position, the panel 110 having a plurality of sealing elements which come into sealing engagement with the neighboring structures thereby forming a barrier against the ingress of flood water. In this embodiment, a pull-bar 122 is provided as the actuating member, which allows the latch to release upon the pull-bar being drawn towards the building occupier so that the panel 110 is swung towards the building interior to the opened position.

Referring to FIGS. 4(*a*) and 4(*b*), an audio or visual message system 124 is provided at the vicinity of the floodgate 10 to provide warning signals in case of an emergency and/or instructions to the building occupiers on how to deactivate the floodgate 10 during an emergency evacuation.

Figure 6A:
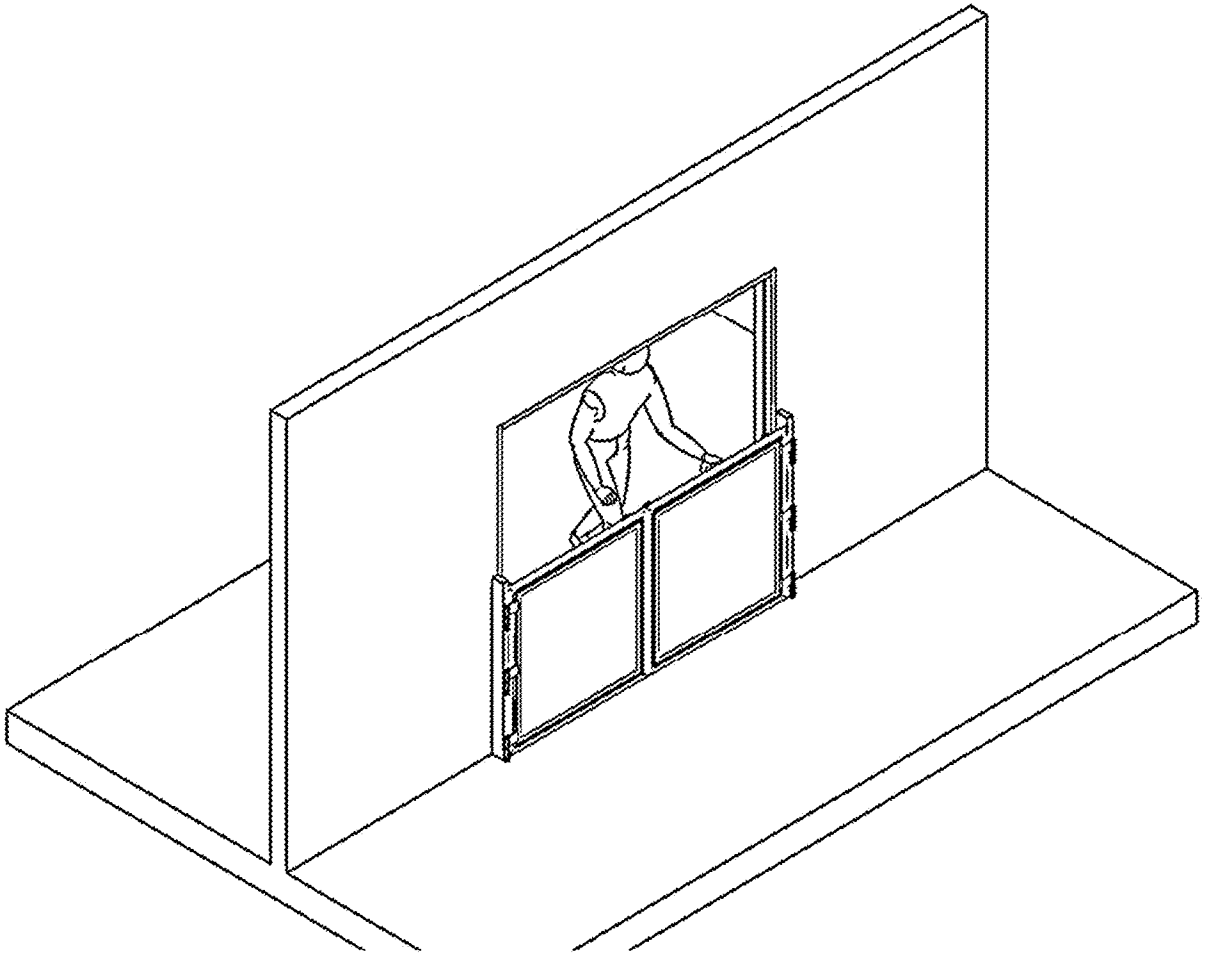
FIG. 6(*a*) and FIG. 6(*b*) are front axonometric views of the floodgate in a closed position and with one panel in an opened position, respectively.
Figure 6B:
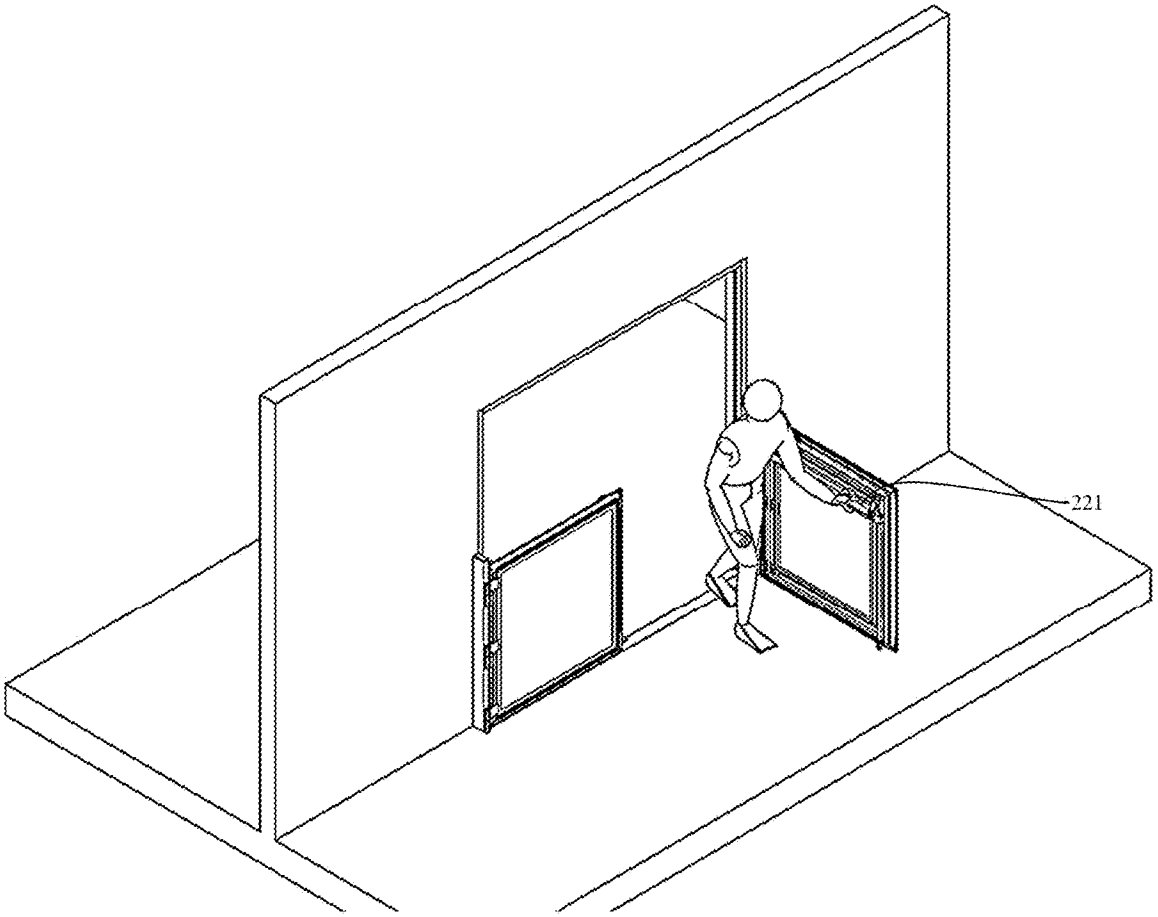
Figure 7A:
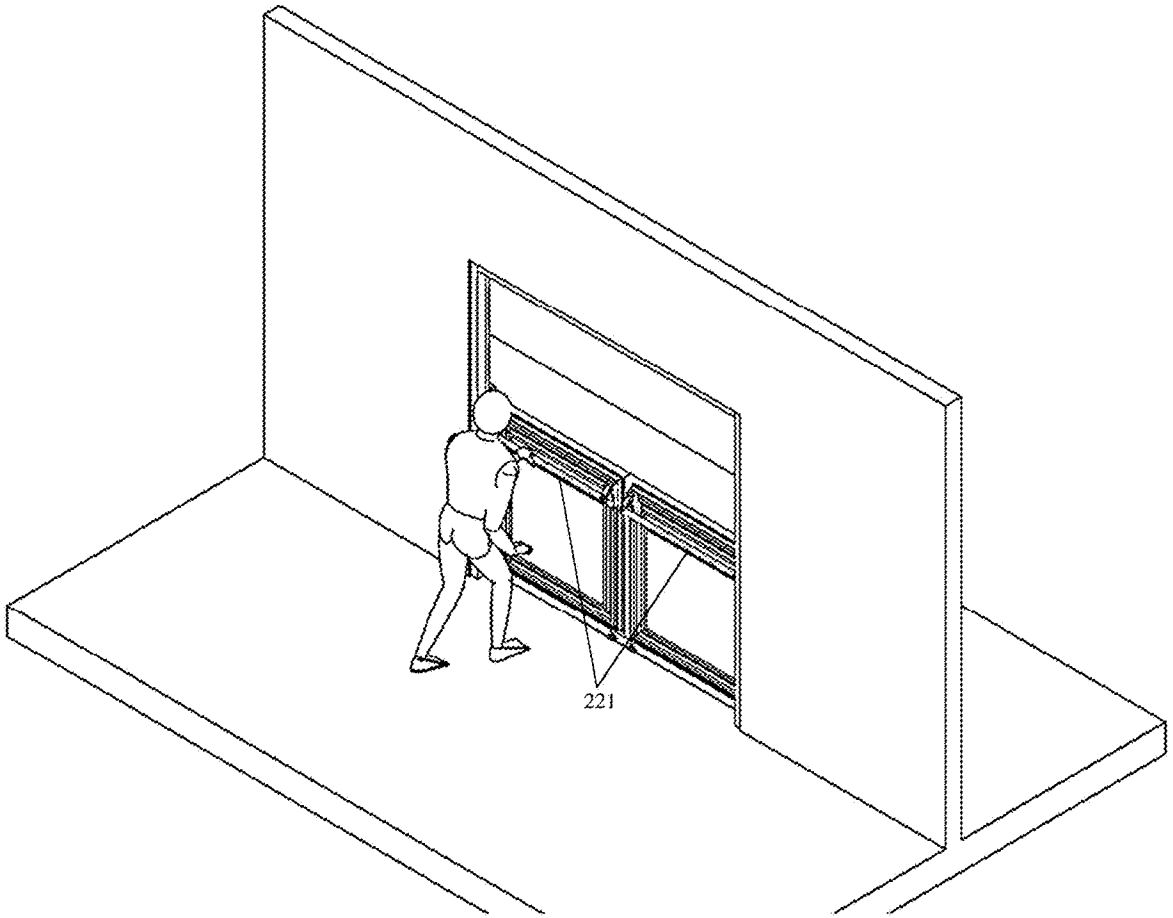
FIG. 7(*a*) and FIG. 7(*b*) are rear axonometric views of the floodgate in a closed position and with one panel in an opened position, respectively.
Figure 7B:
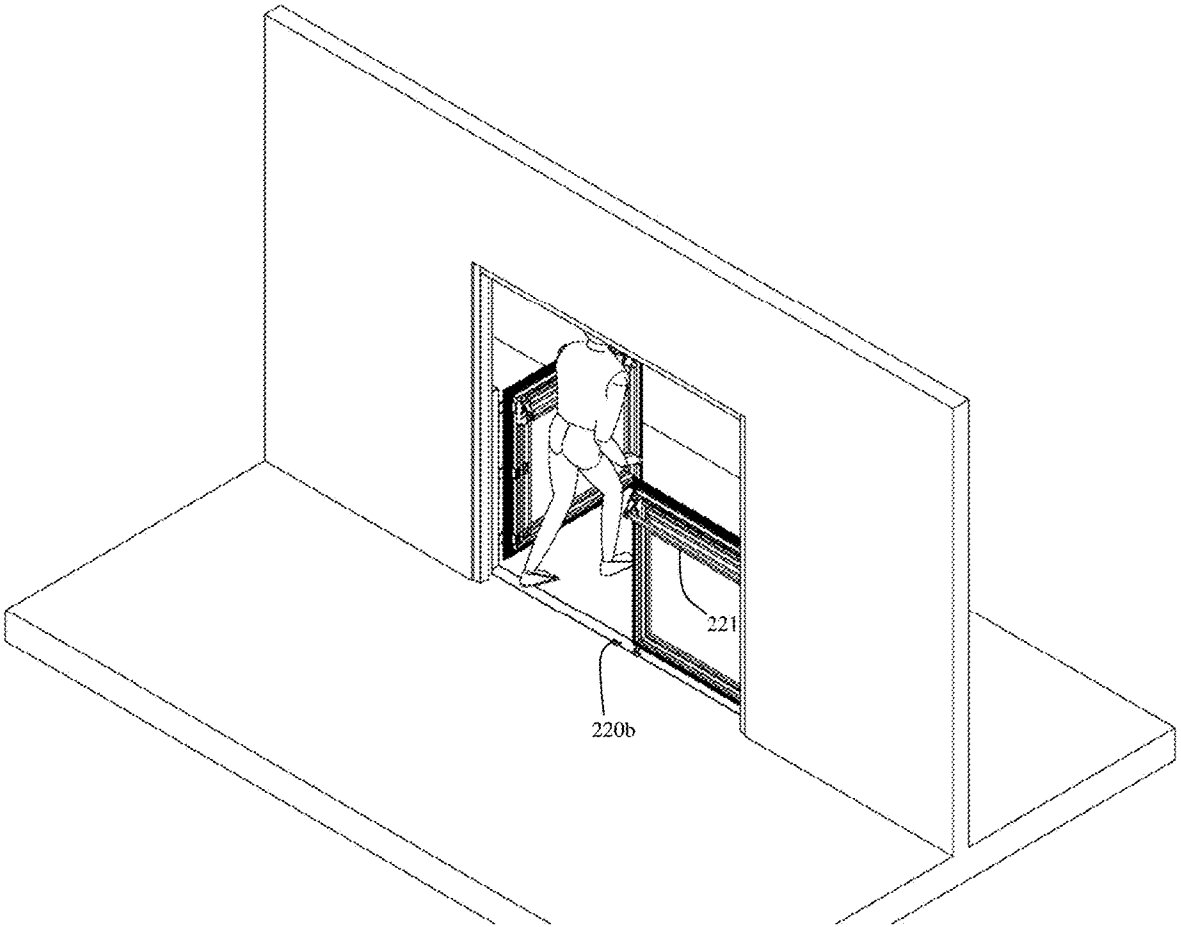
Figure 8A:
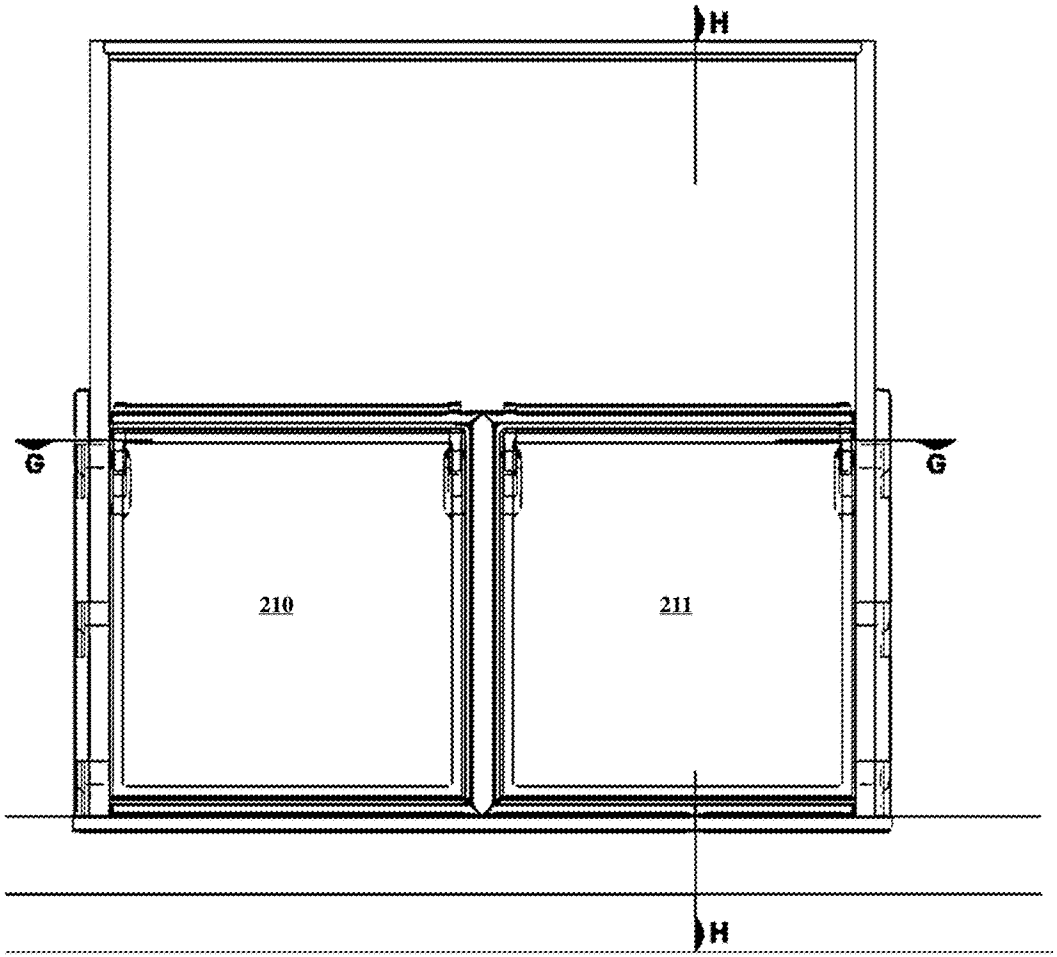
FIG. 8(*a*) is an elevation view of a floodgate according to a further embodiment.
Figure 8B:
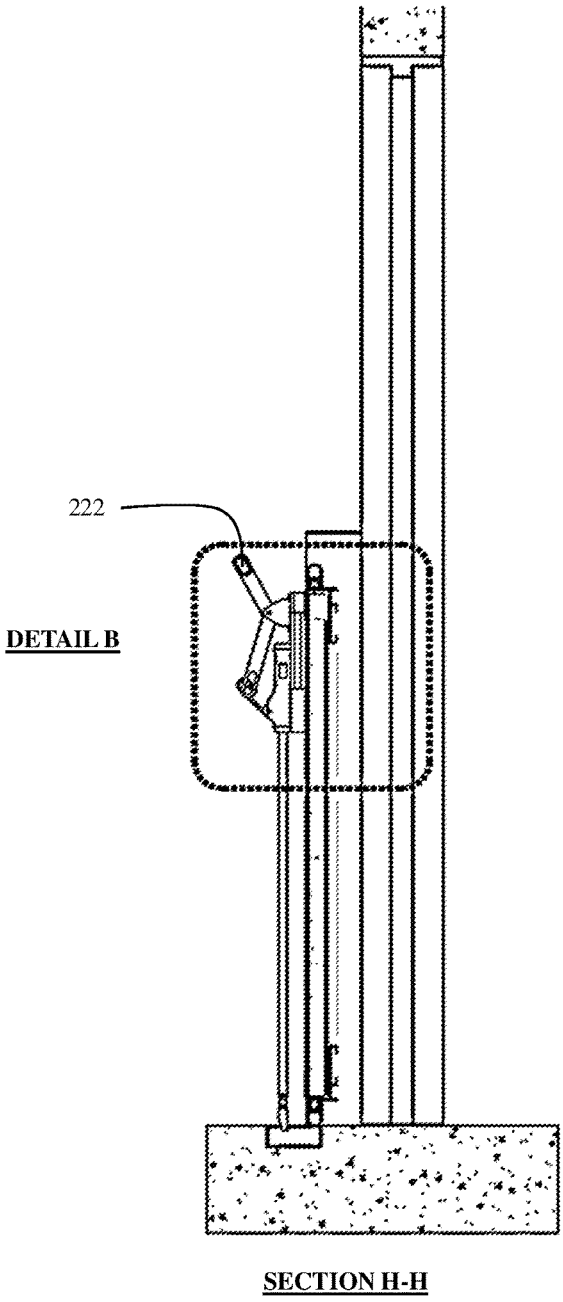
Figure 8C:
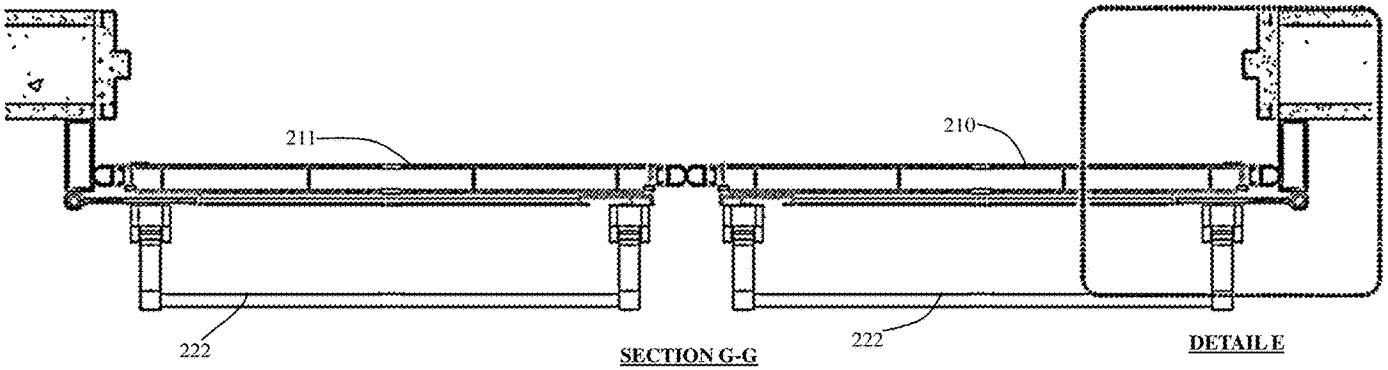
Figure 8D:
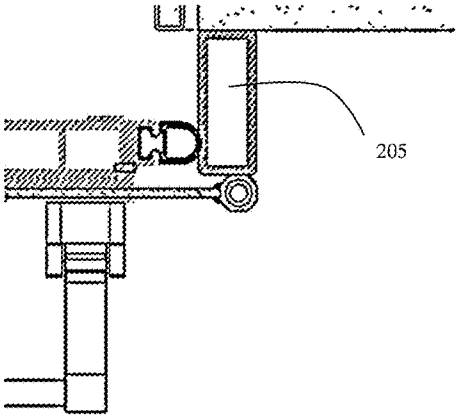
Figure 9A:
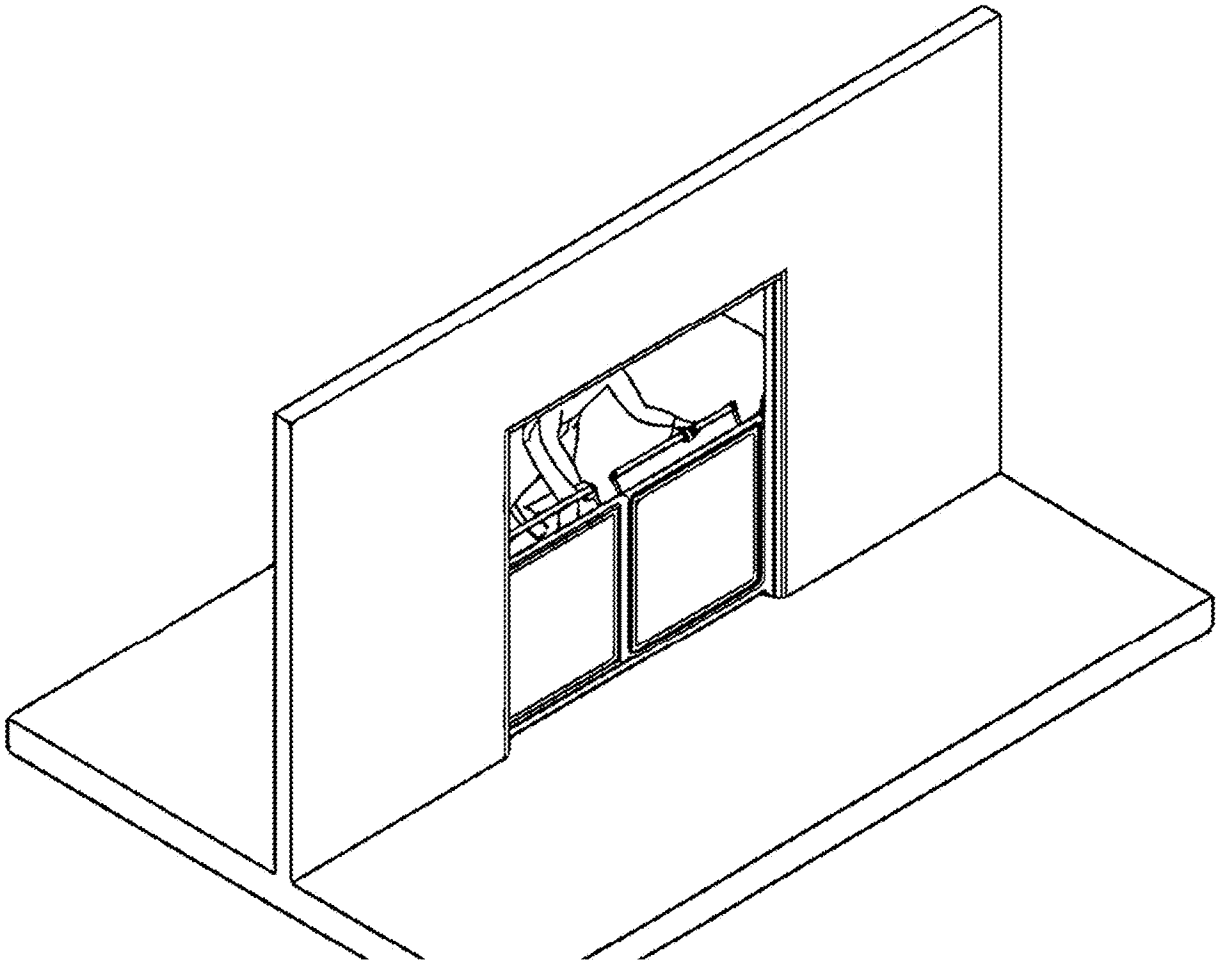
FIG. 9(*a*) and FIG. 9(*b*) are front axonometric views of the floodgate in a closed position and with one panel in an opened position, respectively.
Figure 9B:
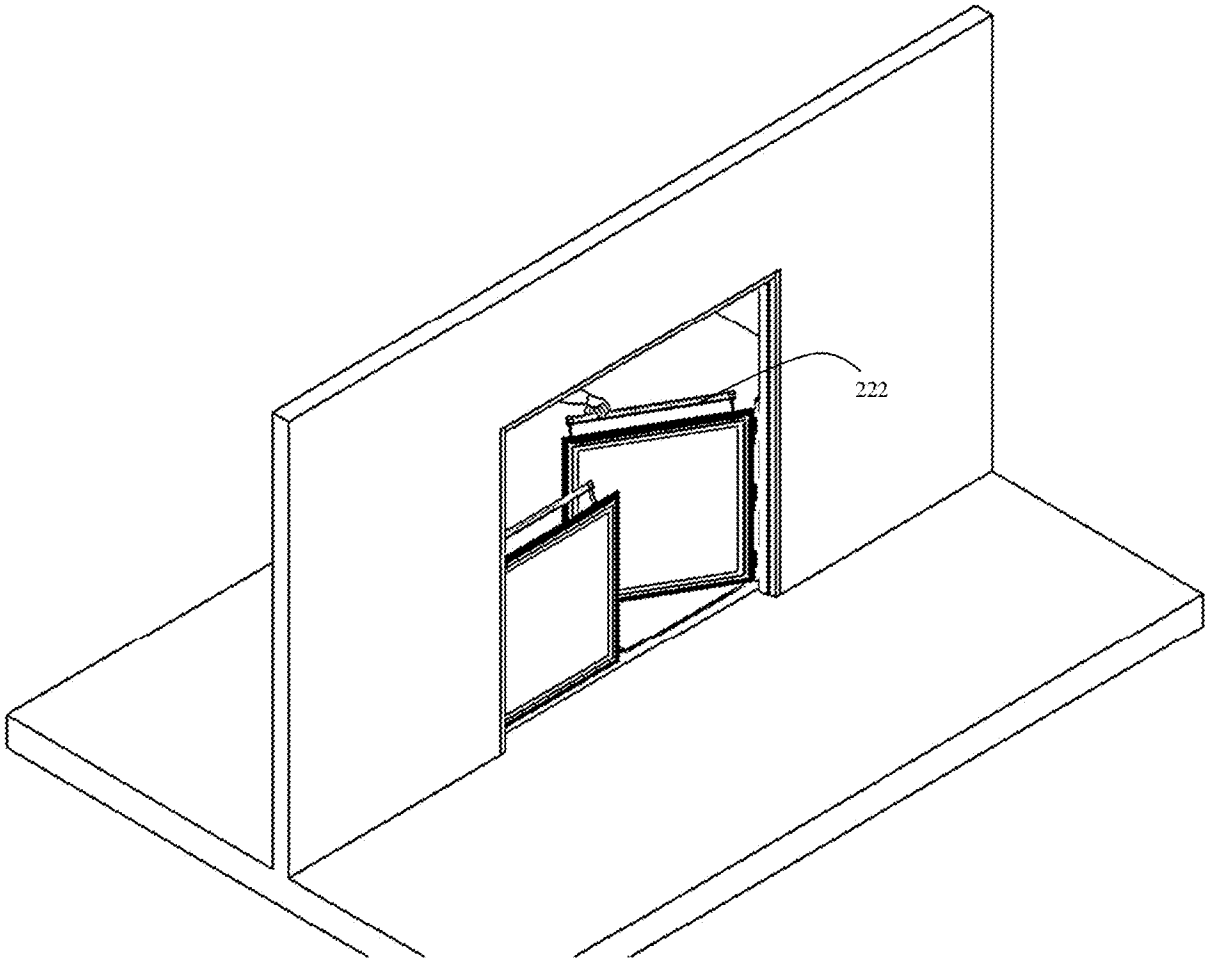
Figure 10A:
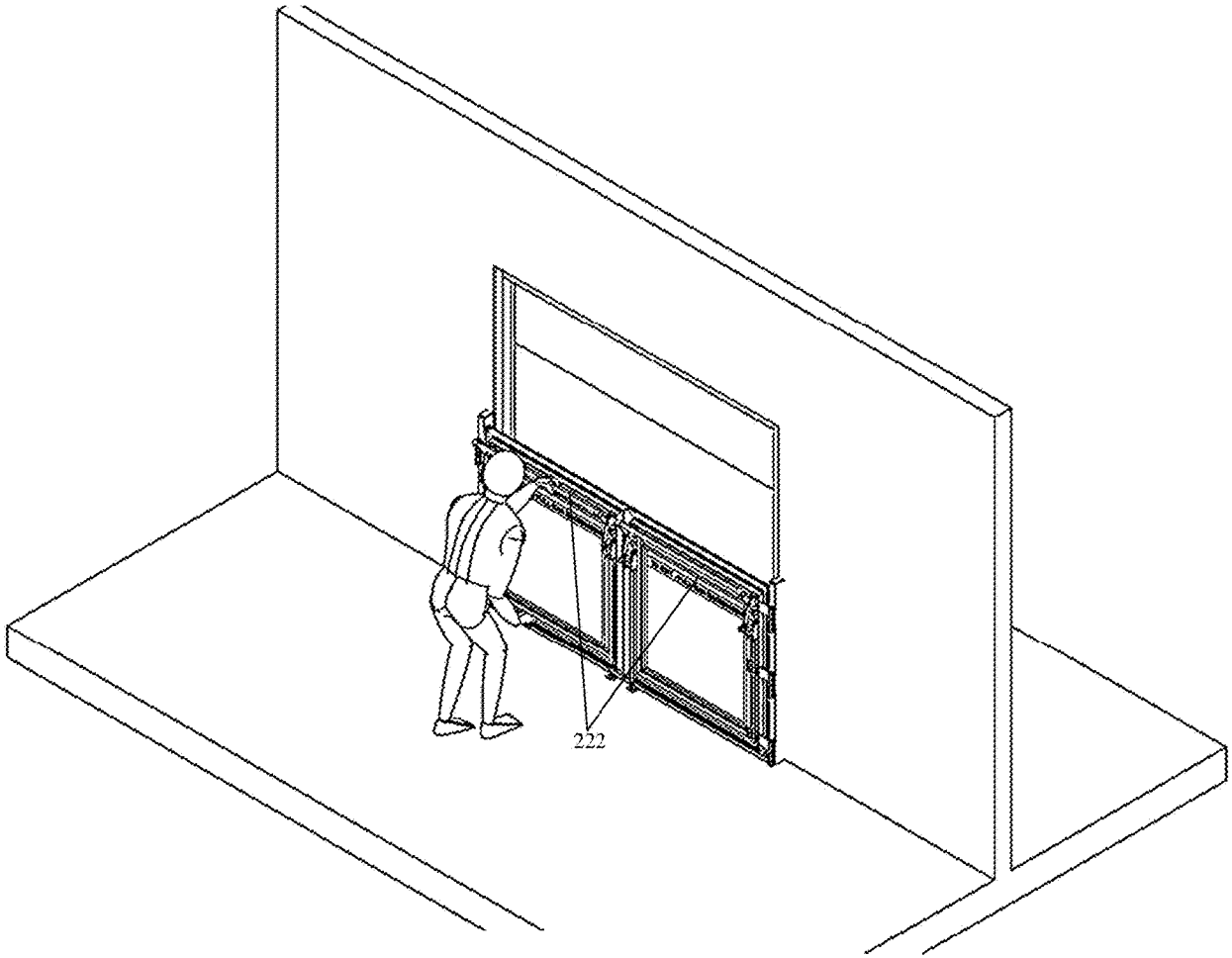
FIG. 10(*a*) and FIG. 10(*b*) are rear axonometric views of the floodgate in a closed position and with one panel in an opened position, respectively FIG. 11(*a*) is an elevation view of a floodgate in a closed position according to a further embodiment.
Figure 10B:
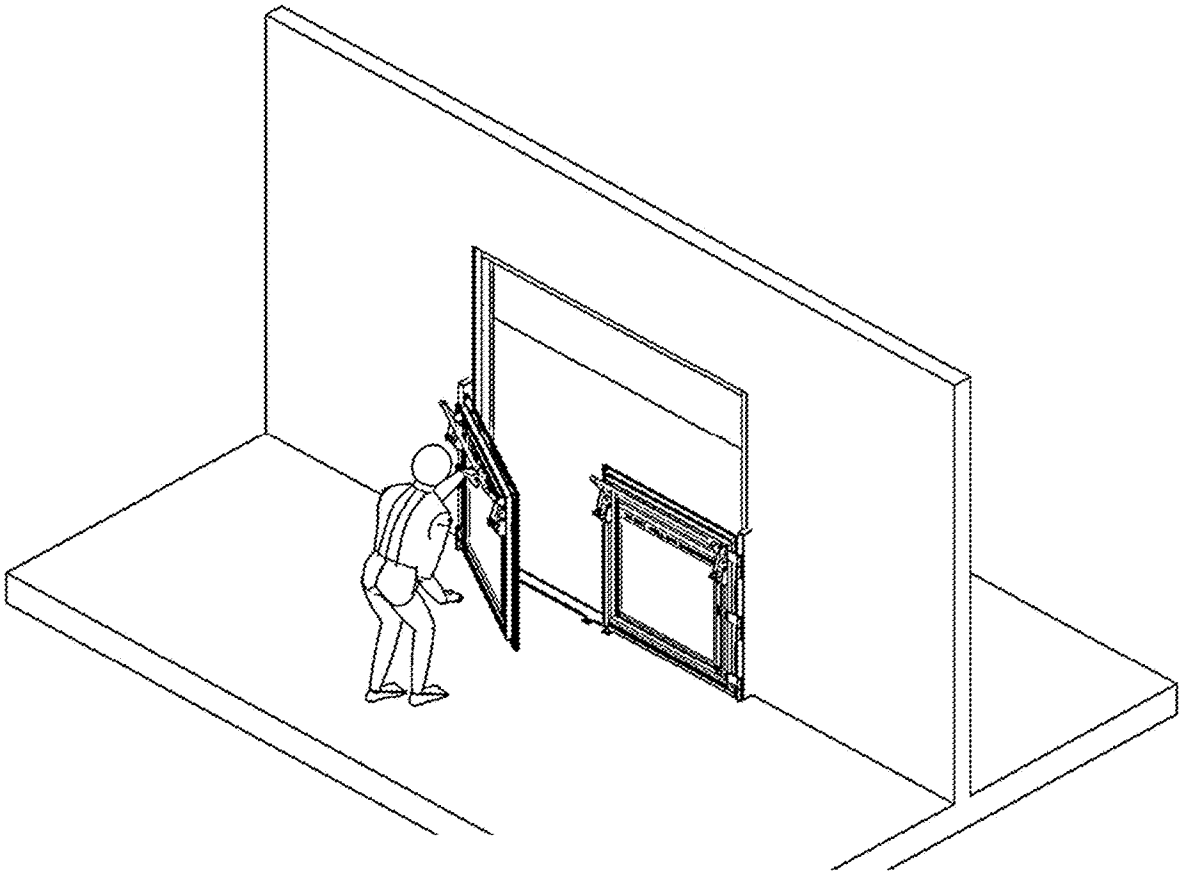
Figure 11A:
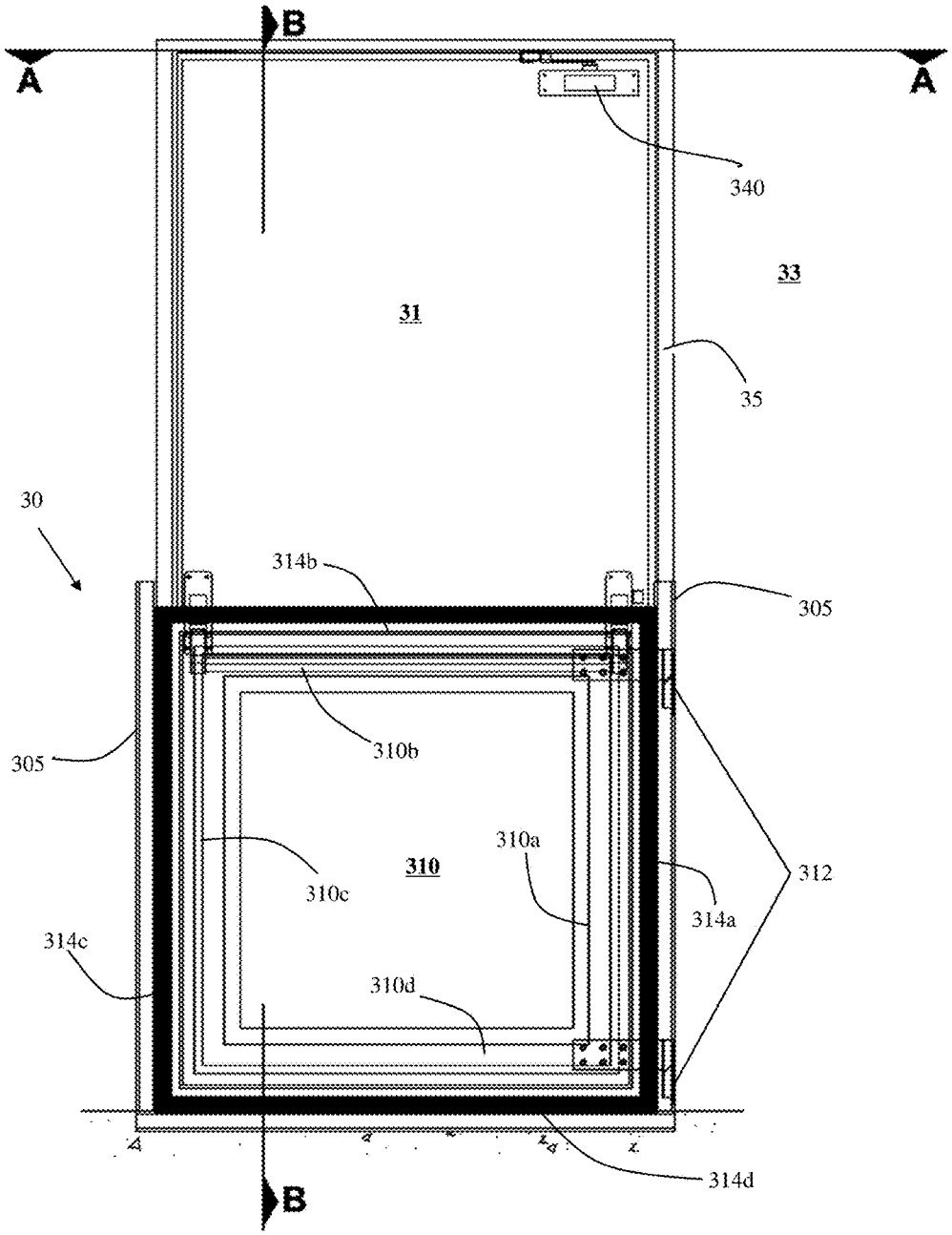
FIG. 11(*b*) is a section view of the floodgate along an axis B-B of FIG. 11(*a*).
Figure 11B:
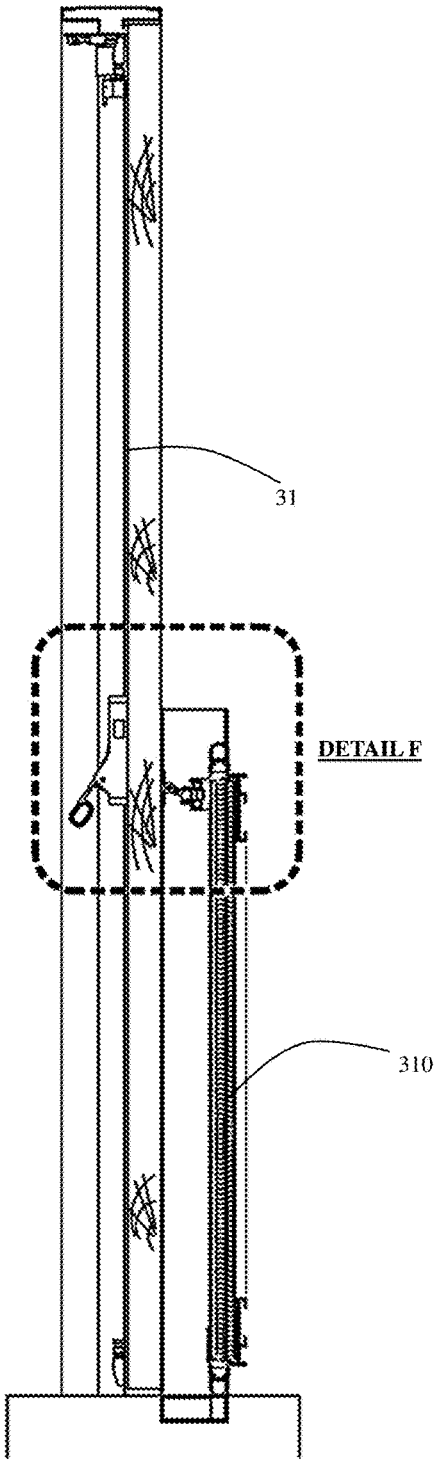
Figure 11C:
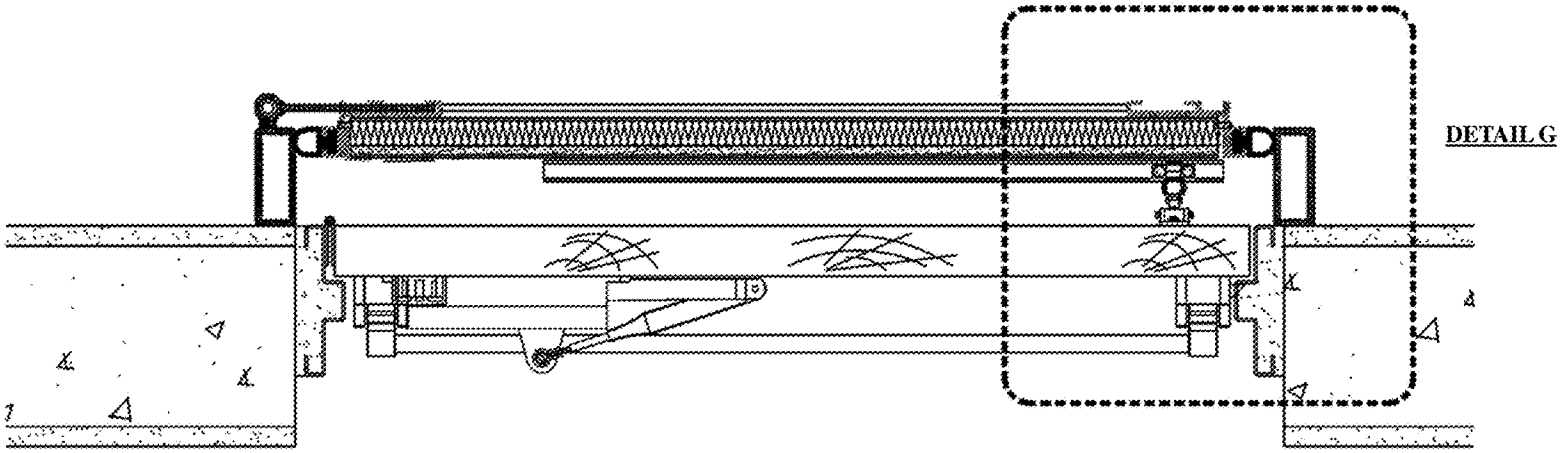
Figure 11E:
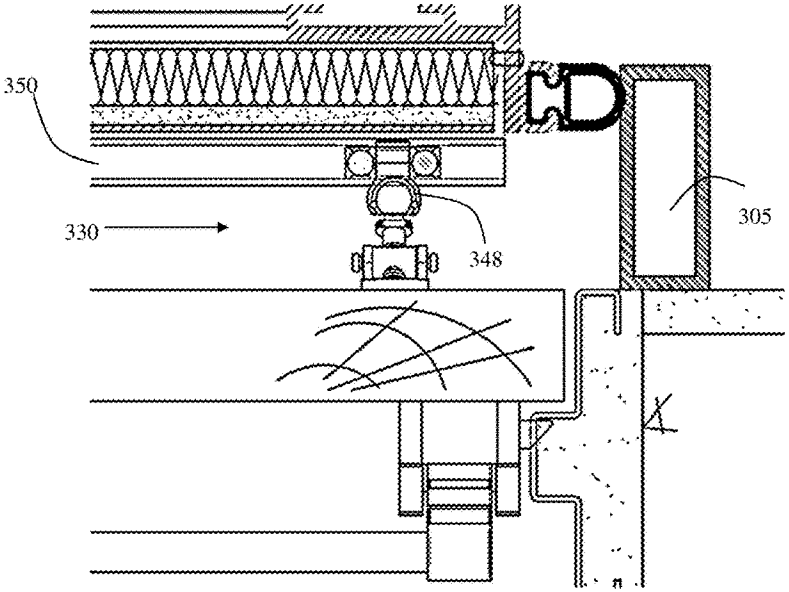
Figure 11D:
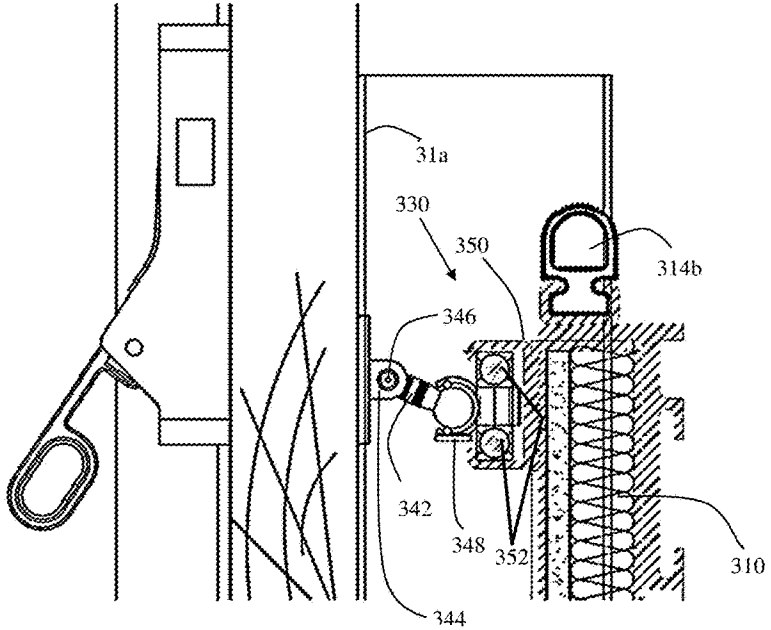
Figure 12A:
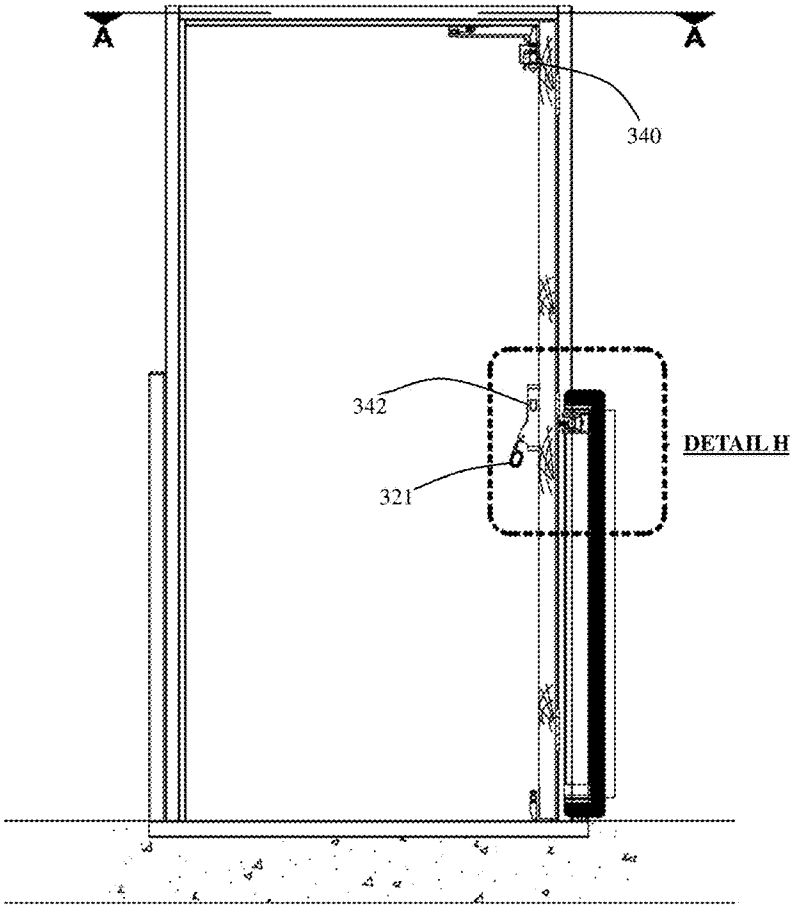
FIG. 12(*a*) is an elevation view of the floodgate in an opened position.
Figure 12B:
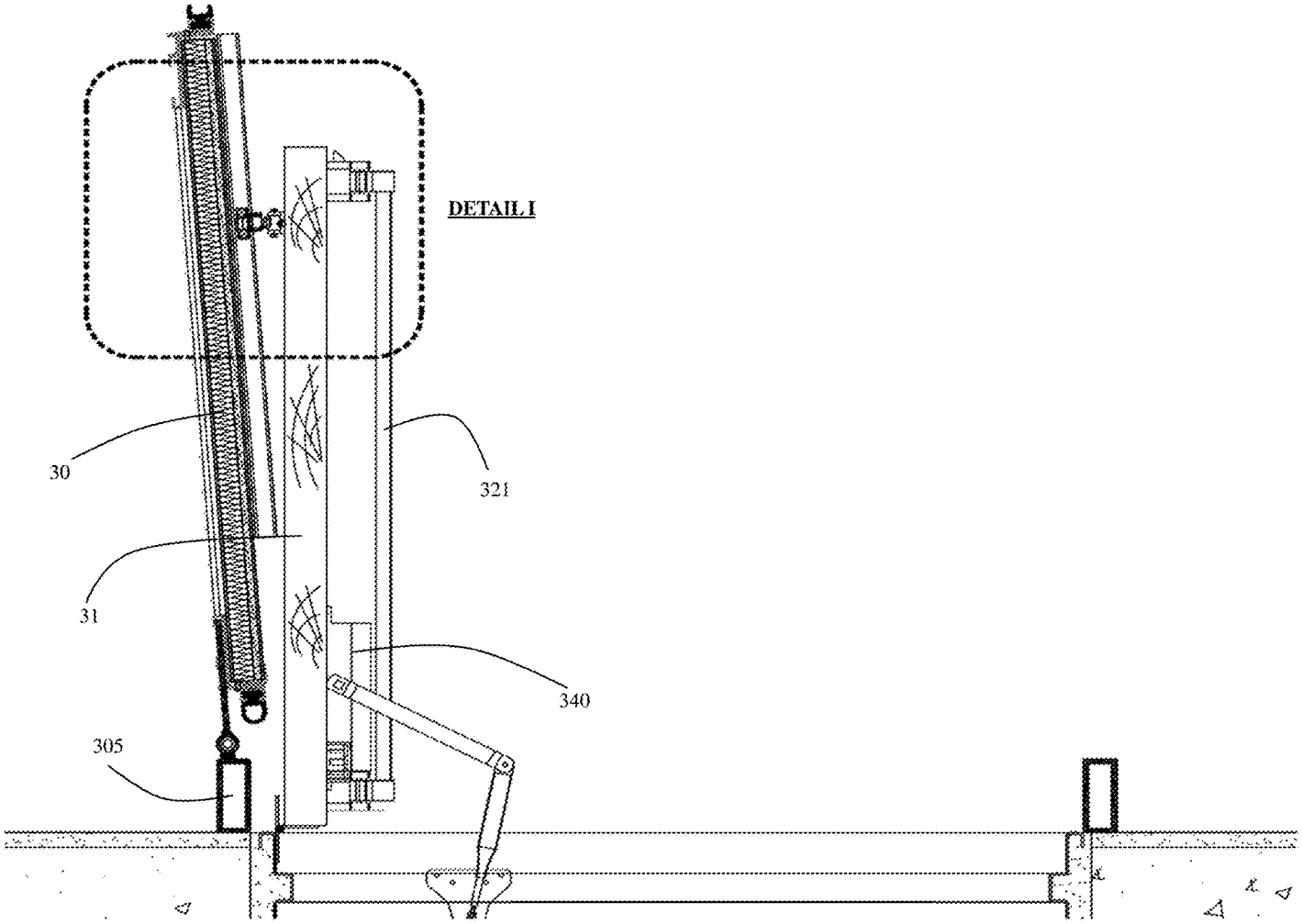
Figure 12D:
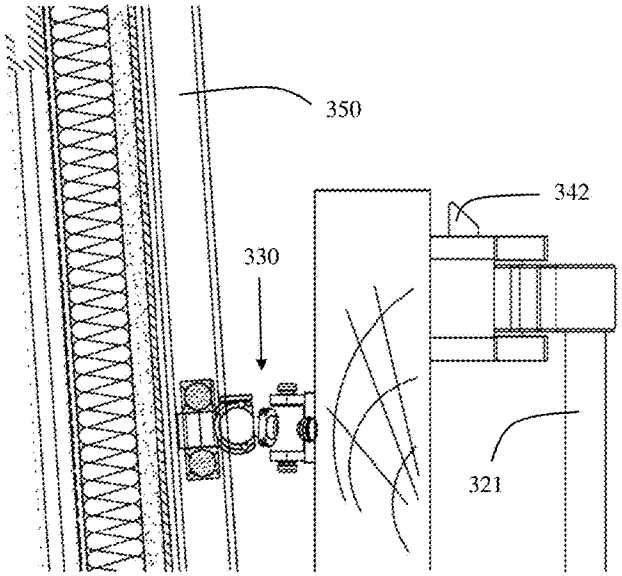
Figure 12C:
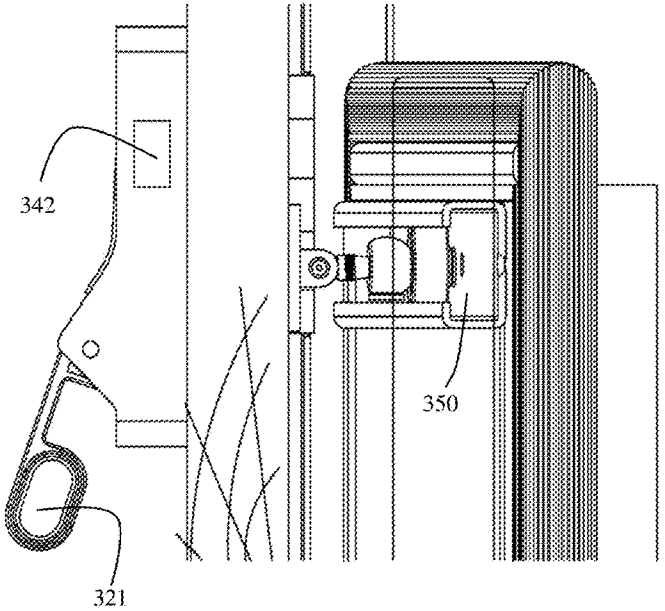
Figure 13B:
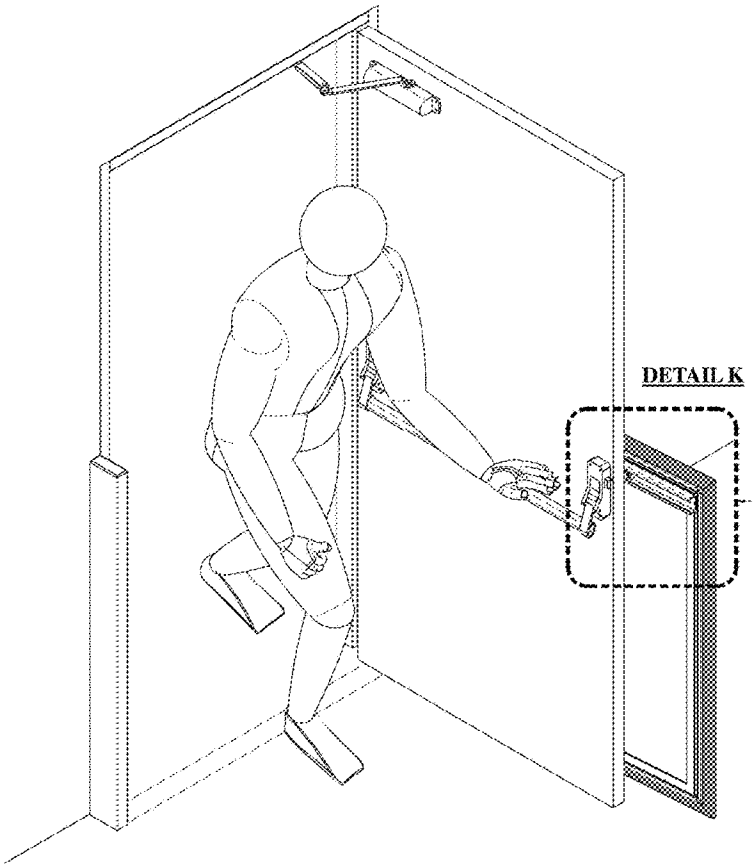
FIG. 13(*a*) and FIG. 13(*b*) are front axonometric views of the floodgate in a closed and an opened position, respectively.
Figure 13A:
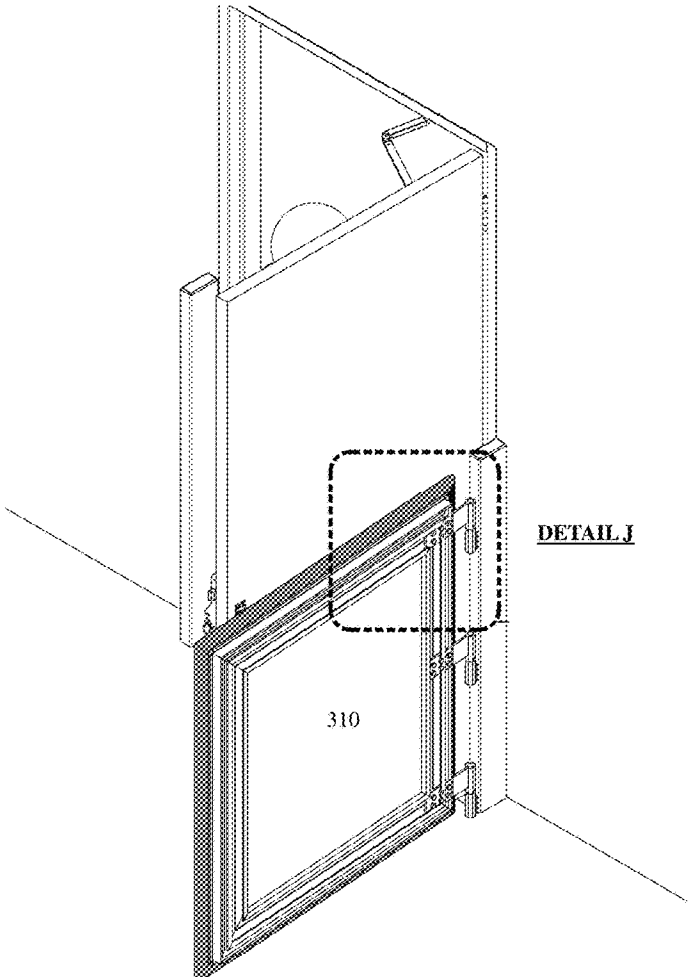
Figure 13D:
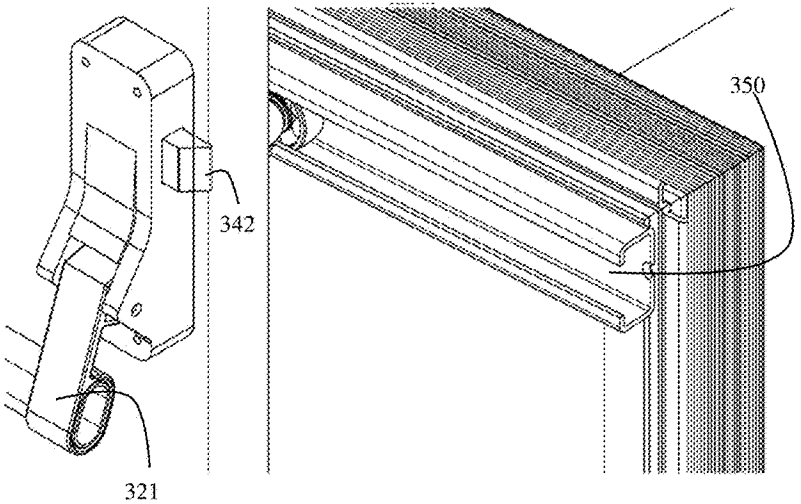
Figure 13C:
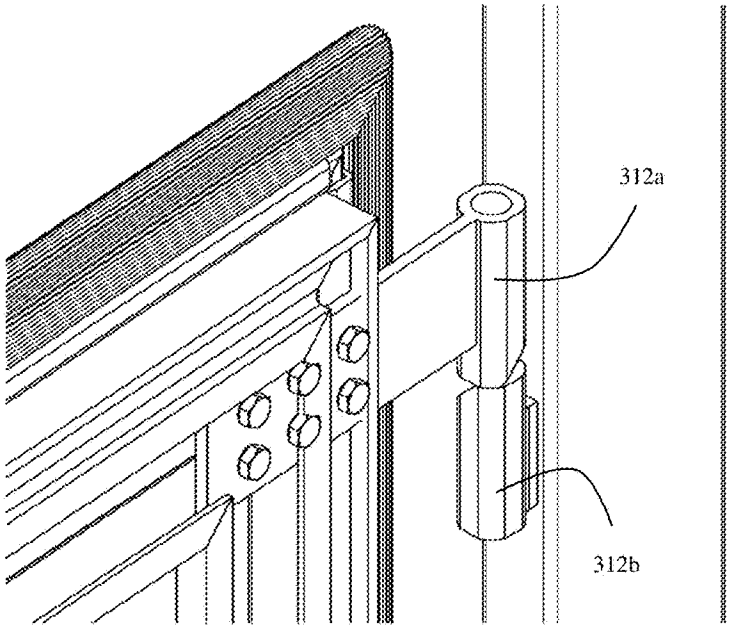
Figure 14B:
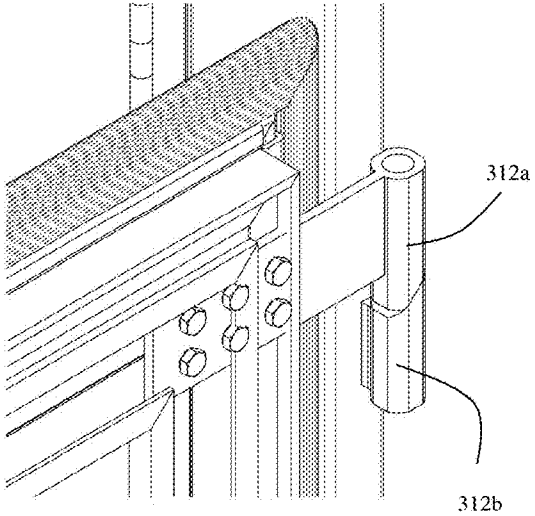
FIG. 14(*a*) is a side axonometric view of the floodgate in an opened position.
Figure 14A:
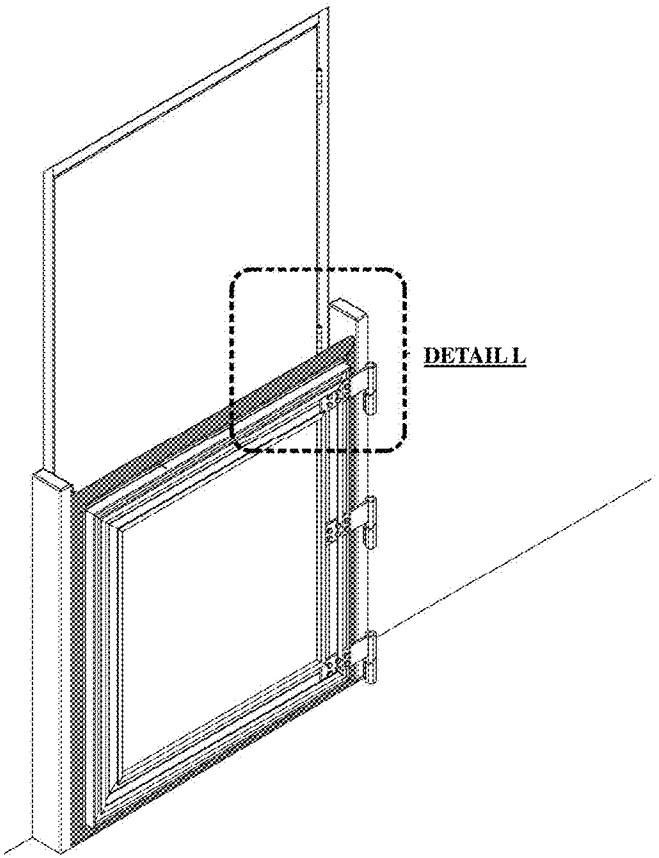

In another embodiment, a double-leaf floodgate 20 is provided as shown in FIGS. 5(*a*)-5(*d*). The floodgate 20 has two panels 210, 211 which are between stanchions 205 disposed at opposing side of the doorway 1 and the panels 210, 211 are respectively coupled to the stanchions 205 for pivotable movement thereabout. It will be understood that each of the panels 210, 211 operates in a similar way as the floodgate panel 110 described in the earlier embodiments. For example, sealing elements 214*d*, 214*f*, are provided for the panels 210, 211 to form sealing engagement with the ground when the panels 210, 211 are in the closed position. Referring to FIG. 6(*a*)-7(*b*), panel 211 is movable about the hinges 212 (which are rising hinges in this example) and is arranged to move away from the ground to release the sealing engagement upon the panel 211 being moved towards the opened position. A sealing element 214*a* arranged at an edge 210*a* of the panel 210 cooperates with an opposing sealing element 214*e* arranged at an edge 211*c* of the panel 211 to form sealing engagement when the panels 210, 211 are in the closed position. Further sealing elements 214*c*, 214*g*, 214*b*, 214*h* may be provided at other edges 210*c*, 211*a*, 210*b*, 211*b* of the panel 210, 211 to maintain water tightness between the floodgate 20 and the installation location such as the stanchions 205. In the above examples, all the sealing elements are vulcanizable corrugated EPDM seals.

Similarly, the floodgate 20 has locking mechanisms biased to secure the panels 210, 211 in the closed position as shown in FIG. 5(*b*). Referring to FIGS. 5(*b*) and 6(*a*)-7(*b*), during an emergency evacuation, an end plug 220*a* is released from a keep plate 220*b* upon the actuation of a push-bar 221. Each of the panels 210, 211 may be opened, closed or otherwise operated independently of the other as shown, for example, in FIGS. 6(*b*) and 7(*b*). Similarly, pull-bars 222 may be used as the actuating mechanism as depicted by another embodiment showing a double-leaf floodgate, as illustrated by FIGS. 8(*a*)-10(*b*).

FIGS. 11(*a*)-11(*e*) show a floodgate 30 according to another embodiment. The floodgate 30 may be used for fitting onto a fire escape door 31 for installation at an emergency exit of a building. In this case, the exit is defined by a wall frame 35 of a wall 33. The fire escape door 31 pivots about an edge of the door to allow the door to swung open and close. The fire escape door 31 is connected to the wall frame 35 by an automatic door closer 340 provided adjacent to an top edge of the door 31 to bias the fire escape door 31 towards the closed position. In use, this allows pivotable movement of the door 31 along an axis extending in an upright direction. It will be understood by a skilled person that hinge mechanism may be provided for allowing pivotable movement of the door 31. In addition, the door 31 may be configured to permit swinging both inwardly and outwardly.

Similar to the floodgate 10 described earlier on, the floodgate 30 has a panel 310 with one edge 310*a* pivotably coupled to a vertical stanchion 305 via hinges 312. Generally, the axes about which the door 31 and panel 310 rotates are parallel to each other. The vertical stanchion 305 is arranged to proximate the wall frame 35 and is laterally projected from the wall 33. Another vertical stanchion 305 is symmetrically provided at the opposing side of the doorway 1. The panel 310 is pivotable about the hinges 312 between an opened position and a closed position at the edge 310*a* about the hinges 312. In the closed position, the panel 310 forms sealing engagement with the neighboring structures and forms a barrier against the ingress of flood water. The panel 310 may be pivoted away from the closed position to provide an access passage along the doorway as shown in FIGS. 13(*a*) to 13(*d*). Similarly, a plurality of sealing elements 314*a*, 314*b*, 314*c*, 314*d* are coupled to the respective edges 310*a*, 310*b*, 310*c*, 310*d* of the panel 310 to form a watertight sealing engagement with the respective neighboring structures when the panel 310 is at the closed position.

Referring to FIGS. 13(*a*), 14(*a*), and 14(*b*), the rising hinges 312 lift up the floodgate panel 310 as the panel 310 rotates from the closed position to an opened position. In particular, the rising hinge 312 comprises a pair of hinge leaves 312*a*, 312*b* cooperate to revolve around an axis. The pair of hinge leaves 312*a*, 312*b* are respectively coupled to the panel 310 and the vertical stanchion 305. When the panel 310 rotates about the axis to an opened position, the hinge leaf 312*a* together with the panel 310 are lifted due to an elevation of an abutting surface between the pair of the hinge leaves 312*a*, 312*b*.

During an emergency evacuation, the door 31 may be required to be opened to a 90-degree position with respect to the plane defined by the wall 33, such that the door is substantially parallel to the direction of the passageway. As shown in FIGS. 12(*a*)-12(*d*), as the door 31 and the panel 310 pivots about the respective axes (which are parallel to each other) towards the opened position, the relative angular position between the door 31 and the panel 310 may vary. Moreover, since the panel 310 is elevated as it is moved towards the opened position, the relative elevation between the door 31 and panel 310 may change, too.

In order to move the floodgate 30 as the door 31 moves, a coupling mechanism is provided to cooperate the floodgate 30 with the fire escape door 31 such that when the fire escape door 31 pivots to an opened position, the panel 310 pivots about the hinges 312 concurrently at a corresponding pace. The coupling mechanism is configured to accommodate relative movement between the door 31 and panel 310 along a lateral direction orthogonal to the upright direction, as will be described in detail below.

In this example, a tandem coupling mechanism is provided to accommodate the relative displacement between the door 31 and the panel 310. In particular, the panel 310 is mechanically coupled to the fire escape door 31 via a linking member 330. The linking member 330 comprises a linkage arm 342 pivotably attached to the exterior-facing surface 31*a* of fire escape door 31 via a mounting bracket 344 and a connector 348 coupling the linkage arm 342 and the panel 310. The linkage arm 342 has one end coupled to the mounting bracket 344 via a hinge pin 346 parallel to the plane of the door 31 and the floor, in this example, to permit a second end of the linkage arm 342 to be raised and lowered, by pivoting the linkage arm 342 within a predefined angular range. The second end of the linkage arm 342 forms a ball and socket bearing connection with the connector 348 coupled to the panel 310 to allow omnidirectional rotational movement between the linkage arm 342 and the connector 348. A guide slot 350 is provided along a lateral dimension of the panel 310 for guiding the movement of the linkage arm 342 together with the connector 348 along the slot 350. The guiding slot 350 has a C-shaped cross-section cooperating with a sealed bearing 352 coupled to the connector 348 to assist slidable movement along the slot 350. The sealed bearing 352 is coupled to the socket of the connector 348 thereby guiding the relative movement between the linking member 330 and the panel 310 while minimizing any friction during the movement. The coupling mechanism 330 consequently allows for the relative movement between the door 31 and the panel 310 in the upright direction, a lateral direction orthogonal to the upright direction and in an angular direction with respect to the axis of rotation. Parts of the coupling mechanism 330 such as the ball and socket bearing may be made of stainless steel or any other suitable material. A skilled person would understand that other ways of implementing the coupling mechanism are available to guide and accommodate the relative movement between the panel and the door to allow concurrent pivotal movement about their respective axes.

Figure 15A:
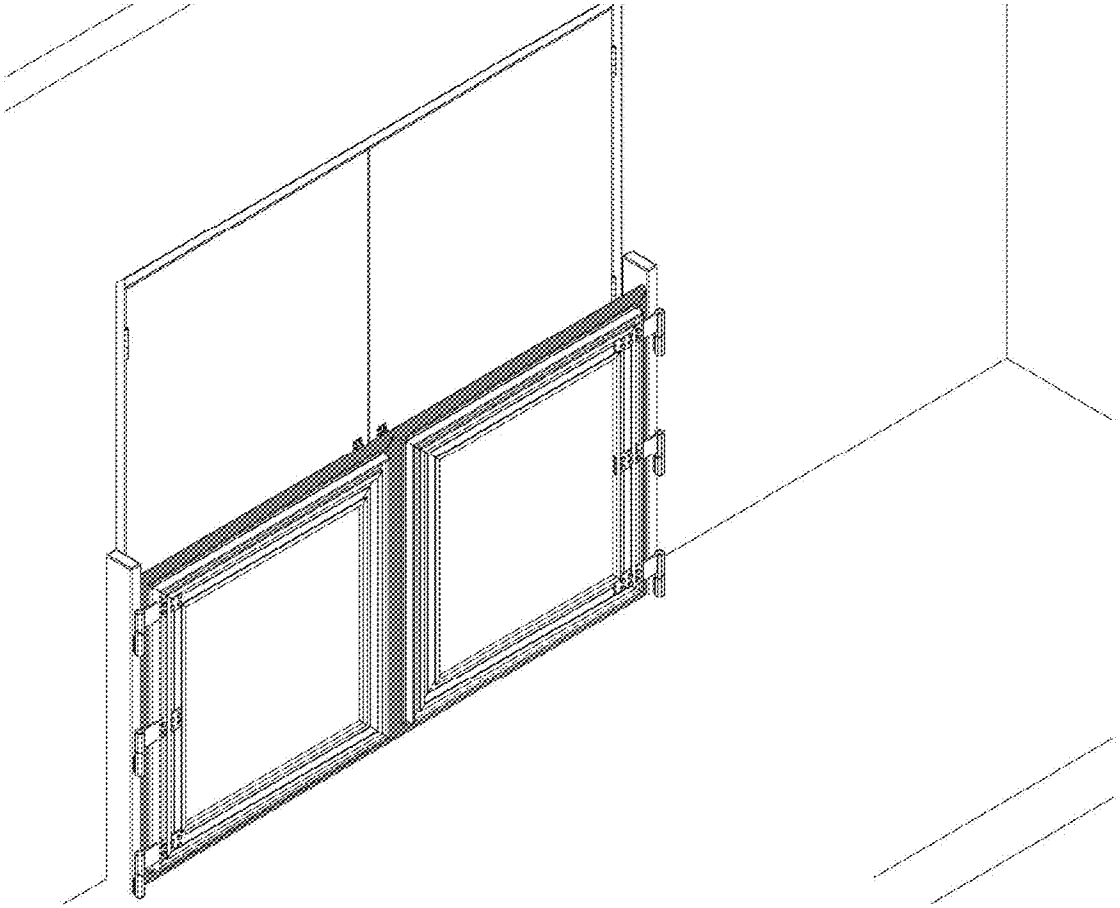
FIG. 15(*a*) and FIG. 15(*b*) are front axonometric views of a floodgate in a closed and an opened position, respectively, according to a further embodiment.
Figure 15B:
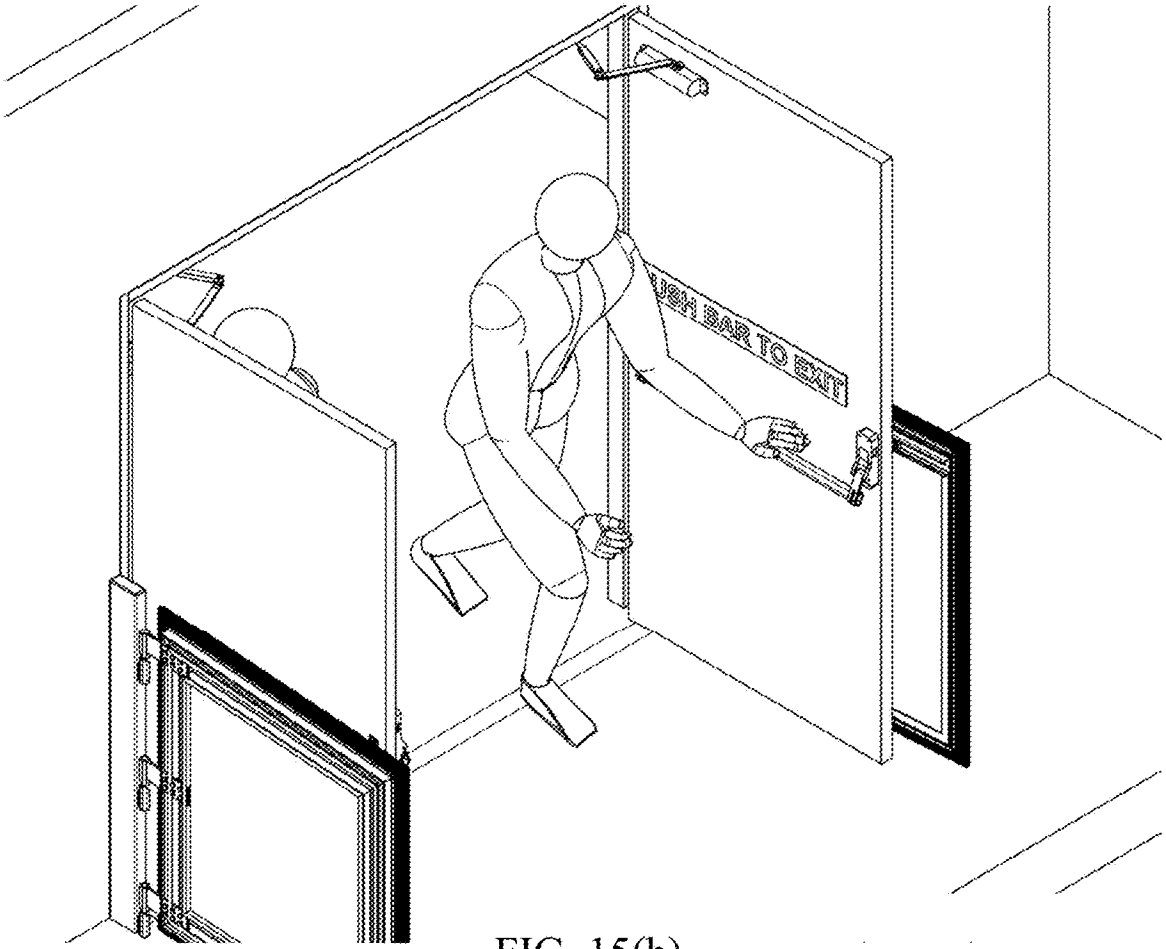
Figure 16A:
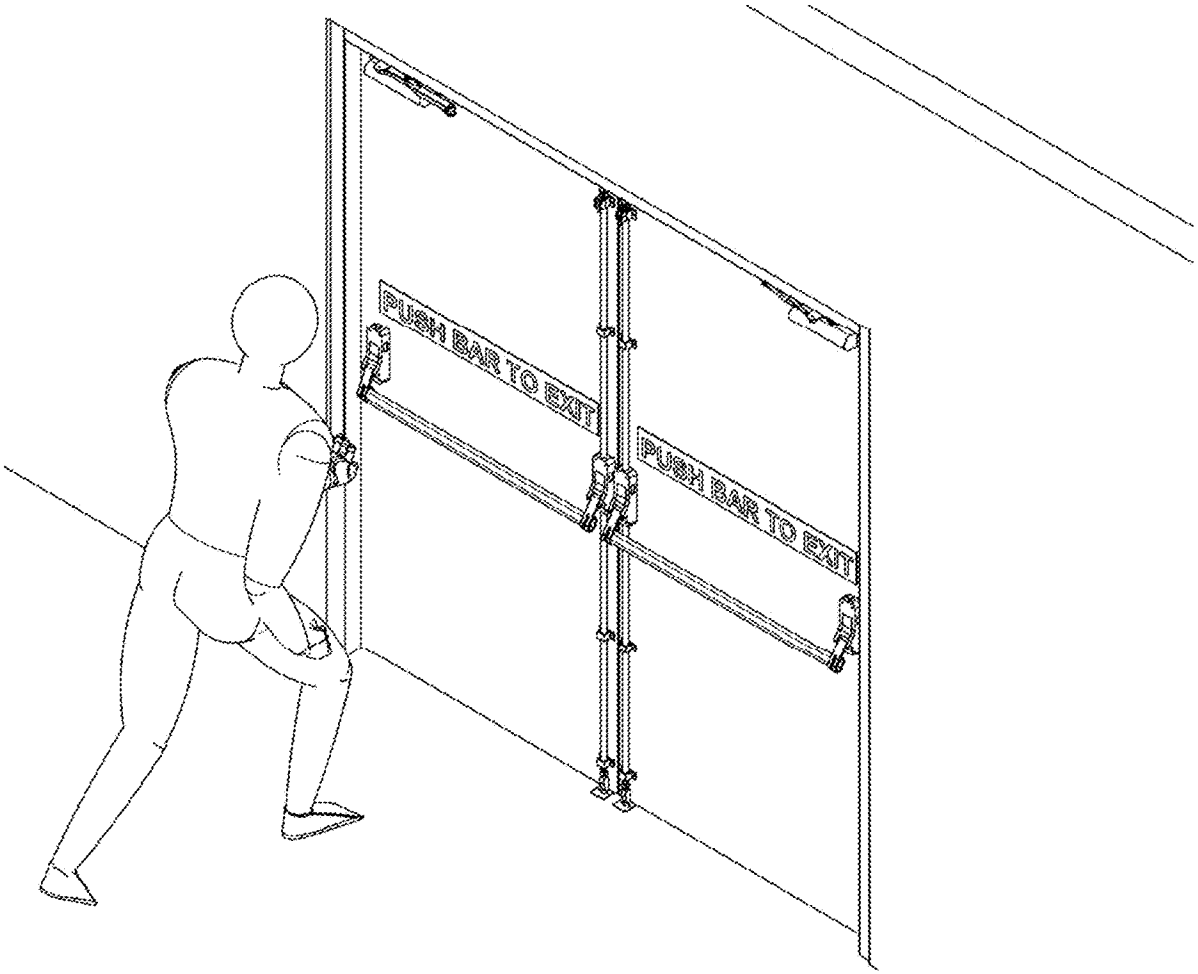
FIG. 16(*a*) and FIG. 16(*b*) are rear axonometric views of the floodgate in a closed and a partial opened position, respectively.
Figure 16B:
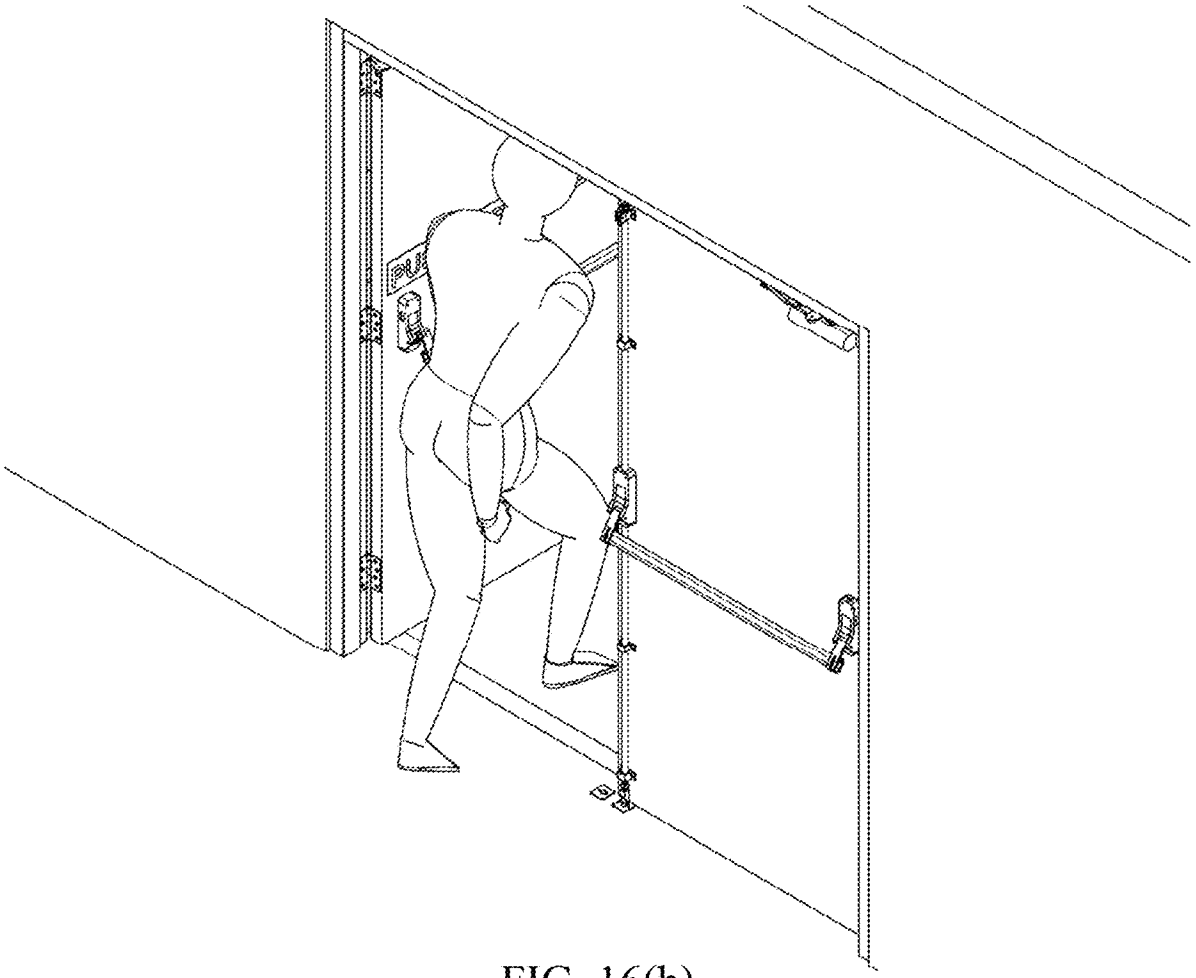
Figure 17:
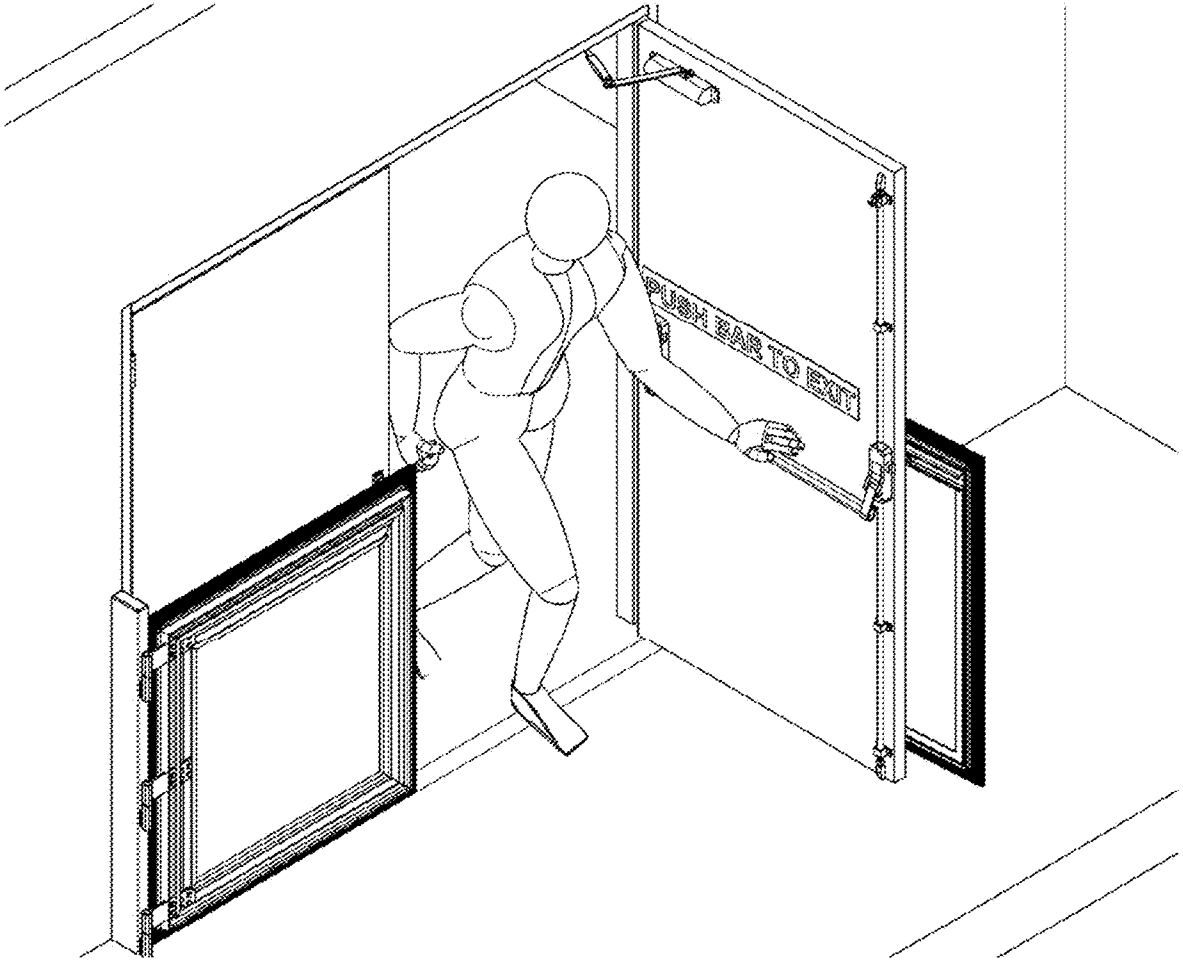
FIG. 17 is a front axonometric view of the floodgate in a partial opened position.
Figure 18A:
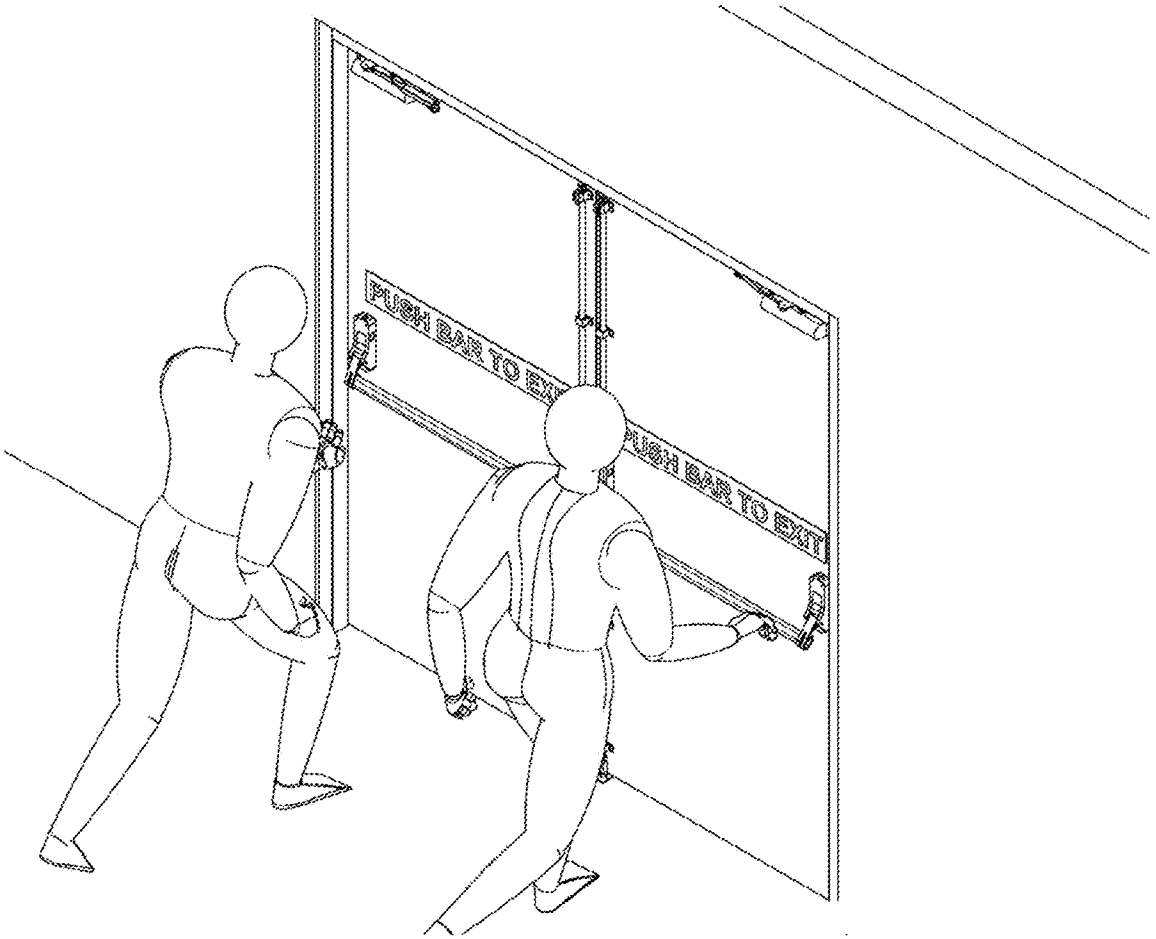
FIG. 18(*a*) and FIG. 18(*b*) are rear axonometric views of the floodgate in a closed position and with one panel in an opened position, respectively.
Figure 18B:
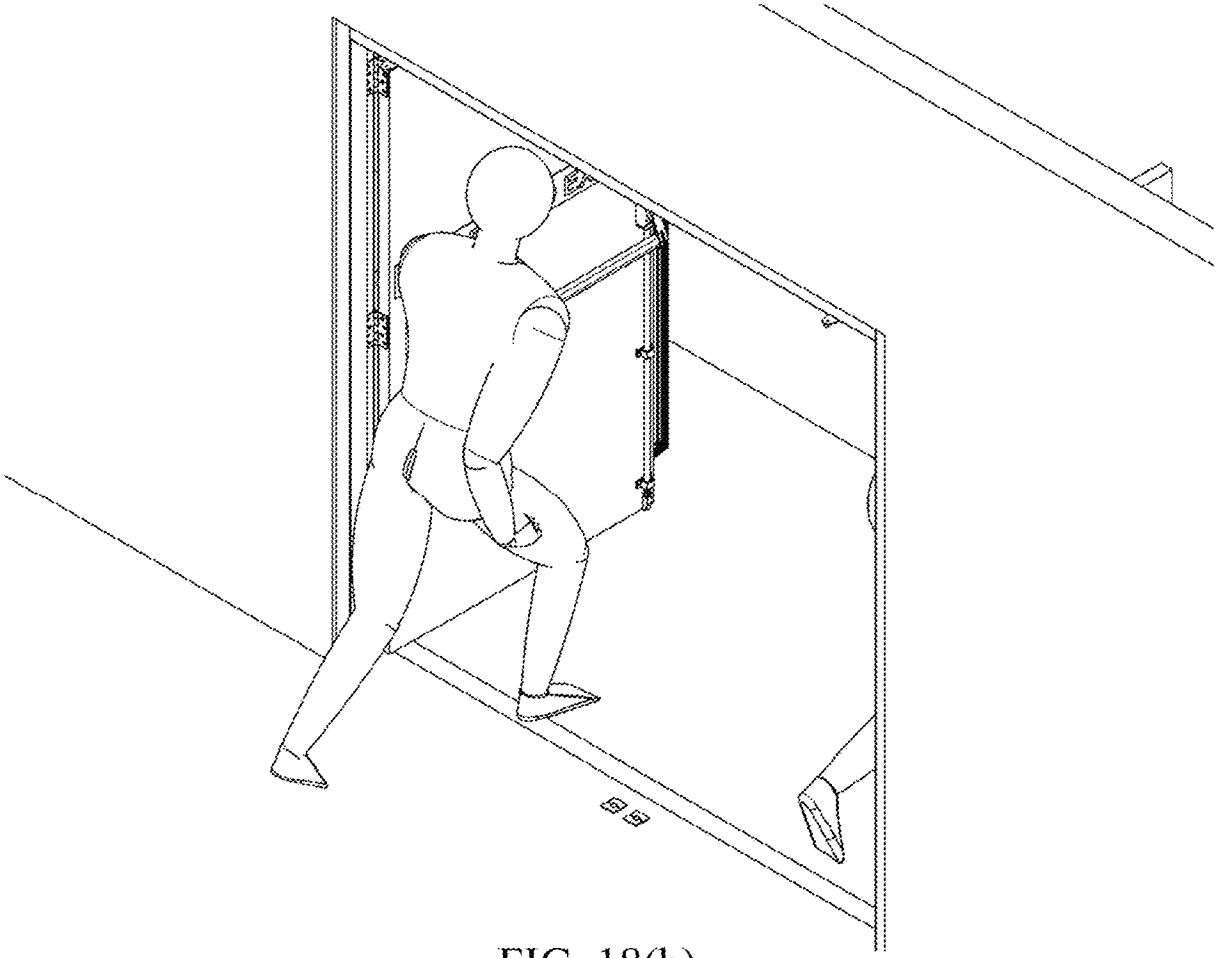
Figure 19:
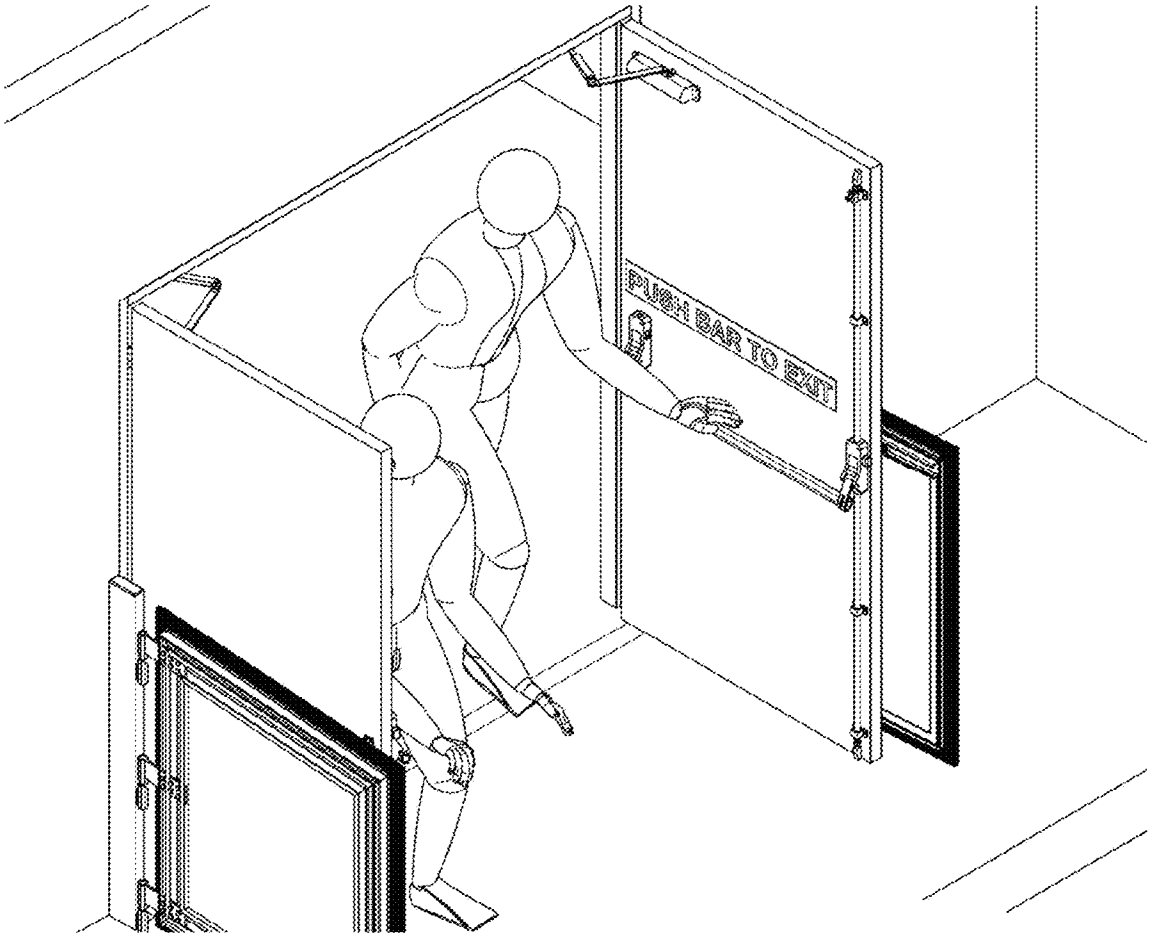
FIG. 19 is a front axonometric view of the floodgate with both panels in an opened position.

In this embodiment, a locking mechanism is implemented as a latch bolt 342 of the door 31 which locks the fire escape door 31 at the closed position to resist the incoming pressure from the water in case of flooding. The latched bolt 342 may be released upon a building occupier actuating a push-bar 321 thereby moving the panel 310 to the opened position. Similarly, the floodgate may be implemented with a double-leaf emergency exit/fire escape door, as illustrated by FIGS. 15(*a*)-19.

While the invention has been illustrated and described in detail in the drawings and foregoing description, such illustration and description are to be considered illustrative or exemplary, and not restrictive; the invention is not limited to the disclosed embodiments. Other variations to the disclosed embodiments can be understood and effected by those skilled in the art in practicing the claimed invention.

For example, the sealing elements and/or the panel may be made of other suitable materials which are suitable for the application, such as materials having a high heat resistance for use as or in conjunction with an emergency exit door.

For another example, the floodgate may be used in other locations other than at emergency exit or in conjunction with the emergency exit door.

What is claimed is:

1. A double-leaf floodgate comprising:

a first panel and a second panel for installation at a doorway to form a barrier against flooding;

a first hinge, the first panel being movable between an opened position and a closed position about a first vertical axis of the first hinge;

a second hinge, the second panel being movable between an opened position and a closed position about a second vertical axis of the second hinge;

a first sealing element coupled to an edge of the first panel to provide sealing engagement with the ground when the first panel is in the closed position;

a second sealing element coupled to an edge of the second panel to provide sealing engagement with the ground when the second panel is in the closed position, wherein the first and second panels are disposed between the first and second vertical axes, and upon being moved from the opened position to the closed position, the first and second panels form the barrier against flooding;

wherein the first hinge is configured to cooperate with the first panel to, upon the first panel being moved from the closed position towards the opened position, cause the first panel to move away from the ground thereby releasing the sealing engagement between the sealing element and the ground; and wherein the second hinge is configured to cooperate with the second panel to, upon the second panel being moved from the closed position towards the opened position, cause the second panel to move away from the ground, thereby releasing the sealing engagement between the sealing element and the ground.

2. The floodgate according to claim 1, wherein each of the first and second hinges comprises a rising hinge.

3. The floodgate according to claim 1, wherein each of the first and second sealing elements comprises a sealing surface forming sealing engagement with the ground, the sealing surface comprising corrugations.

4. The floodgate according to claim 3, wherein the corrugations comprise ribs extending in a direction at an angle to a direction perpendicular to the first and second panel, respectively.

5. The floodgate according to claim 3, wherein, upon the sealing engagement, the sealing surface is contiguous with a threshold plate coupled to the ground.

6. The floodgate according to claim 1, wherein each of the first and second sealing elements has a cross-section tapered towards the ground, said cross-section being perpendicular to a length of the respective edge.

7. The floodgate according to claim 1, further comprising, for each of the first and second panels, a plurality of sealing elements attached to a plurality of edges of the panel thereby forming sealing engagement with neighboring structures at the respective edges.

8. The floodgate according to claim 1, further comprising a locking member for securing the first and second panels in the closed position.

9. The floodgate according to claim 8, further comprising an actuating member adapted to deactivate the locking member to allow the first and second panels to move towards the opened position.

10. The floodgate according to claim 1, wherein each of the first and second panels is coupled to a wall via the hinge.

11. The floodgate according to claim 10, wherein, for each of the first and second panels, the panel is connected to a support post via the hinge; the support post laterally projecting from a plane defined by the wall.

12. The floodgate according to claim 11, wherein, for each of the first and second panels, an edge of the panel adjacent to the hinge forms sealing engagement with the support post.

13. The floodgate according to claim 1, wherein each of the first and second panels is formed of aluminum based composite material.

14. The floodgate according to claim 1, wherein the first and second panels cooperate to form sealing engagement at opposing neighboring edges.

15. A floodgate comprising:

a first panel for installation at a doorway to form a barrier against flooding;

at least one hinge, the first panel being movable between an opened position and a closed position about a first vertical axis of the hinge; and a sealing element coupled to an edge of the panel to provide sealing engagement with the ground when the first panel is in the closed position, thereby forming the barrier against flooding;

wherein the hinge is arranged to corporate with the first panel to, upon the first panel being moved from the closed position towards the opened position, cause the first panel to move away from the ground thereby releasing the sealing engagement between the sealing element and the ground;

wherein the floodgate further comprises a coupling mechanism configured to cooperate with a second panel, the second panel being movable about a second vertical axis of the hinge;

wherein the coupling mechanism is configured to, upon the second panel pivoting about the second vertical axis, cause the first panel to pivot about the first vertical axis of the hinge at a corresponding angle.

16. The floodgate according to claim 15, wherein the coupling mechanism is configured to accommodate relative movement of the panels along a vertical direction.

17. The floodgate according to claim 16, wherein the coupling mechanism is configured to accommodate relative movement of the panels along a lateral direction orthogonal to the vertical direction.

18. The floodgate according to claim 17, wherein the coupling mechanism comprises a linking member configured to cooperate with a guide slot extending along the lateral direction of the first panel, the linking member being operable to pivot about the guiding slot.

* * * * *